US011309630B2

(12) United States Patent
Pretorius et al.

(10) Patent No.: US 11,309,630 B2
(45) Date of Patent: Apr. 19, 2022

(54) ANTENNA

(71) Applicant: LICENSYS AUSTRALASIA PTY LTD, Sumner (AU)

(72) Inventors: Albertus Jacobus Pretorius, Sumner (AU); Abraham Gert Willem Du Plooy, Mt. Barker (AU); Ahmed Toaha Mobashsher, St. Lucia (AU); Konstanty Stanislaw Bialkowski, Sinnamon Park (AU)

(73) Assignee: LICENSYS AUSTRALASIA PTY LTD, Sumner (AU)

( * ) Notice: Subject to any disclaimer, the term of this patent is extended or adjusted under 35 U.S.C. 154(b) by 98 days.

(21) Appl. No.: 16/500,016

(22) PCT Filed: Mar. 21, 2018

(86) PCT No.: PCT/AU2018/050259

§ 371 (c)(1),
(2) Date: Oct. 1, 2019

(87) PCT Pub. No.: WO2018/218279

PCT Pub. Date: Dec. 6, 2018

(65) Prior Publication Data

US 2020/0119449 A1 Apr. 16, 2020

(30) Foreign Application Priority Data

May 30, 2017 (AU) ..... 2017902047

(51) Int. Cl.
*H01Q 1/32* (2006.01)
*H01Q 9/04* (2006.01)
(Continued)

(52) U.S. Cl.
CPC ..... *H01Q 9/0414* (2013.01); *H01Q 1/2216* (2013.01); *H01Q 1/3233* (2013.01); *H01Q 1/42* (2013.01); *H01Q 9/18* (2013.01)

(58) Field of Classification Search
CPC ..... H01Q 1/38; H01Q 1/2225; H01Q 1/3233; H01Q 1/42; H01Q 1/2216; H01Q 1/48;
(Continued)

(56) References Cited

U.S. PATENT DOCUMENTS

2005/0110627 A1* 5/2005 Sabet ..... B60C 23/0408 340/447
2005/0122265 A1* 6/2005 Gaucher ..... H01Q 1/38 343/700 MS (Continued)

FOREIGN PATENT DOCUMENTS

WO WO 00/21031 4/2000
WO WO 2015/157814 10/2015
WO WO 2016/008004 1/2016

OTHER PUBLICATIONS

Examination Report issued in EP Application No. 18810736 (dated Jul. 9, 2020).

(Continued)

*Primary Examiner* — David E Lotter
(74) *Attorney, Agent, or Firm* — Barnes & Thornburg LLP; G. Peter Nichols

(57) ABSTRACT

An antenna for a communication device is disclosed. The antenna has a structure including a ground plane and a lid component. The lid component is conductive, substantially planar and has a planform shape which is lesser in a first lid component dimension ($L_1$) than it is in a second lid component dimension ($L_2$) perpendicular to the first lid component dimension ($L_1$). The ground plane is conductive and substantially planar, and the size of the ground plane is greater than the size of the lid component. The lid component is conductively connected to the ground plane but also spaced apart from the ground plane, such that there is a space between the lid component and the ground plane, and the antenna is center fed.

21 Claims, 15 Drawing Sheets

(51) Int. Cl.
*H01Q 1/22* (2006.01)
*H01Q 1/42* (2006.01)
*H01Q 9/18* (2006.01)

(58) Field of Classification Search
CPC .. H01Q 1/3275; H01Q 1/2208; H01Q 9/0407; H01Q 1/36; H01Q 1/243; H01Q 9/0414; H01Q 9/18; H01Q 9/0421; H01Q 1/3225
See application file for complete search history.

(56) References Cited

U.S. PATENT DOCUMENTS

2018/0175490 A1* 6/2018 Meng ..... H01Q 1/48
2018/0247177 A1* 8/2018 Pudenz ..... H01Q 1/2216

OTHER PUBLICATIONS

Koohestani et al., "A Novel, Low-Profile, Vertically-Polarized UWB Antenna for WBAN," IEEE Transactions on Antennas and Propagation, 62(4): 188 8-1894 (Apr. 2014).
Nakano et al., "A Wideband Low-Profile Antenna Composed of a Conducting Body of Revolution and a Shorted Parasitic Ring," IEEE Transactions on Antennas and Propagation, 56(4): 1187-1192 (Apr. 2008).
Search Report and Written Opinion issued in Int'l. App. No. PCT/AU2018/050259 (2018).
Supplementary Search Report issued in EP Application No. 18810736 (2020).

* cited by examiner (i)

(ii)

(iii)

| Φ = | 90 | 0 |
|---|---|---|
| Set | Read | Read |
| | Trace1 [dB] | Trace2 [dB] |
| Θ=0 | | |
| Θ=10 | | |
| Θ=20 | | |
| Θ=30 | | |
| Θ=40 | | |
| Θ=50 | 7,8 | 0,5 |
| Θ=60 | 7,7 | 0,0 |
| Θ=70 | 6,2 | -1,7 |
| Θ=80 | 3,6 | -3,4 |
| Θ=90 | 0,1 | -5,9 |
| Θ=100 | -20,0 | -20,0 |
| Θ=110 | -20,0 | -20,0 |
| Θ=120 | -20,0 | -20,0 |
| Θ=130 | -20,0 | -20,0 |
| Θ=140 | -20,0 | -20,0 |
| Θ=150 | -20,0 | -20,0 |
| Θ=160 | -20,0 | -20,0 |
| Θ=170 | -20,0 | -20,0 |
| Θ=180 | -20,0 | -20,0 |
| Θ=190 | | |
| Θ=200 | | |
| Θ=210 | | |
| Θ=220 | | |
| Θ=230 | | |
| Θ=240 | | |
| Θ=250 | | |
| Θ=260 | | |
| Θ=270 | | |
| Θ=280 | | |
| Θ=290 | | |
| Θ=300 | | |
| Θ=310 | | |
| Θ=320 | | |
| Θ=330 | | |
| Θ=340 | | |
| Θ=350 | | |
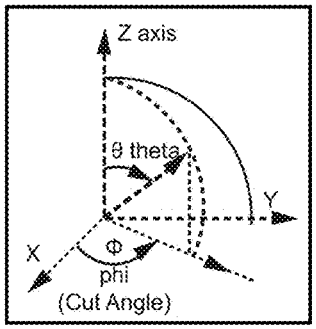
| | |
|---|---|
| **Title:** 137x80x20 Wafer+Radome<br>**Date:** 9 Mar17 | |
| **Comment** Compact measutement<br>Compact measutement,<br>1.2m dia GND | |
| | | |
|---|---|---|
| Φ = | 90 | |
| MaxGain= | 7,8 | [dBi] |
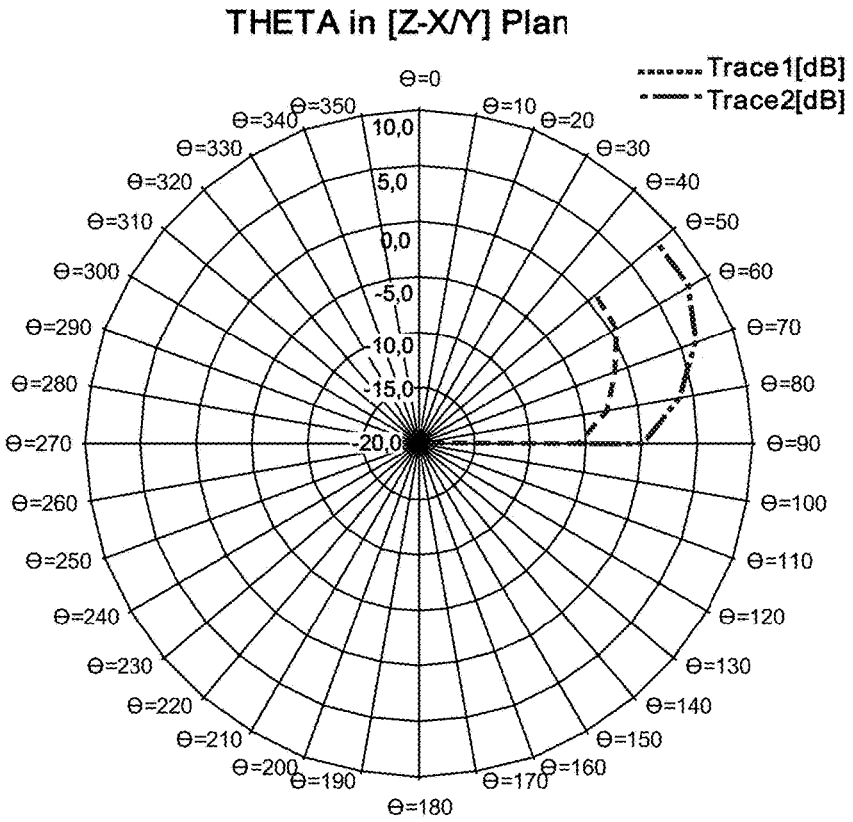
(i)a - Wafer with 20mm P.E.S. radome. Elevation, Long-side vs short-side
FIG. 18 (i)a

| ϕ = | 85 |
|---|---|
| Set | Read |
| | Trace[dB] |
| Φ=180 | -7,0 |
| Φ=170 | -5,9 |
| Φ=160 | -4,5 |
| Φ=150 | -3,1 |
| Φ=140 | -2,3 |
| Φ=130 | -0,3 |
| Φ=120 | 0,8 |
| Φ=110 | 1,2 |
| Φ=100 | 1,7 |
| Φ=90 | 1,7 |
| Φ=80 | 1,5 |
| Φ=70 | 1,1 |
| Φ=60 | 0,6 |
| Φ=50 | -1,1 |
| Φ=40 | -2,6 |
| Φ=30 | -4 |
| Φ=20 | -5,3 |
| Φ=10 | -6,2 |
| Φ=0 | -6,8 |
| Φ=350 | -20 |
| Φ=340 | -20 |
| Φ=330 | -20 |
| Φ=320 | -20 |
| Φ=310 | -20 |
| Φ=300 | -20 |
| Φ=290 | -20 |
| Φ=280 | -20 |
| Φ=270 | -20 |
| Φ=260 | -20 |
| Φ=250 | -20 |
| Φ=240 | -20 |
| Φ=230 | -20 |
| Φ=220 | -20 |
| Φ=210 | -20 |
| Φ=200 | -20 |
| Φ=190 | -20 |
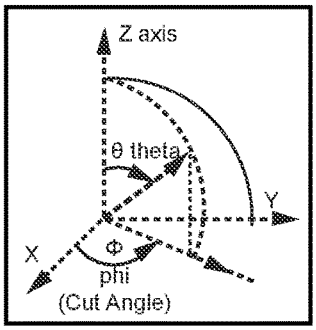
Title: 137x80x20 Wafer+Radome
Date: 9 Mar17
Comment Compact measutement
Compact measutement,
1.2m dia GND
| θ = | 85 | |
|---|---|---|
| MaxGain= | 1,7 | [dBi] |
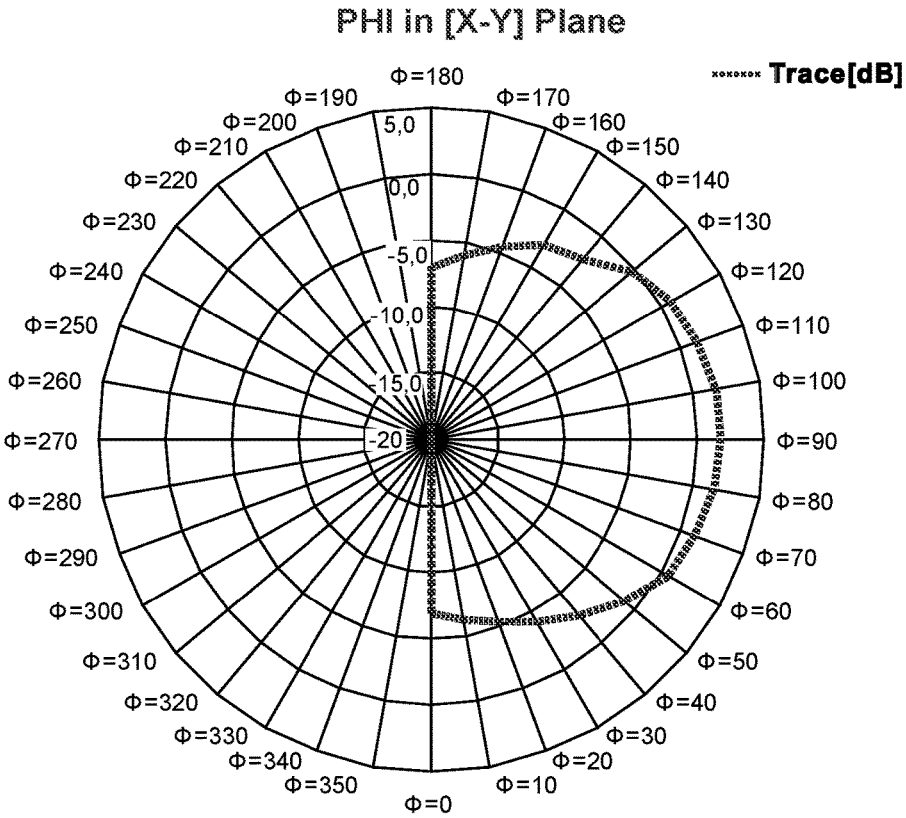
(i)b - Azimuth, at 5 deg elevation.
FIG. 18 (i)b

| ϕ = | 90 | Mushroom |
|---|---|---|
| Set | Read | Read |
| | Trace1 [dB] | Trace2 [dB] |
| Θ=40 | | |
| Θ=50 | | |
| Θ=60 | | |
| Θ=70 | | |
| Θ=80 | | |
| Θ=90 | 7,8 | 4,8 |
| Θ=100 | 7,7 | 3,6 |
| Θ=110 | 6,2 | 1,8 |
| Θ=120 | 3,6 | 0,6 |
| Θ=130 | 0,1 | -2,0 |
| Θ=140 | -20,0 | -20,0 |
| Θ=150 | -20,0 | -20,0 |
| Θ=160 | -20,0 | -20,0 |
| Θ=170 | -20,0 | -20,0 |
| Θ=180 | -20,0 | -20,0 |
| Θ=190 | -20,0 | -20,0 |
| Θ=200 | -20,0 | -20,0 |
| Θ=210 | -20,0 | -20,0 |
| Θ=220 | -20,0 | -20,0 |
| Θ=230 | | |
| Θ=240 | | |
| Θ=250 | | |
| Θ=260 | | |
| Θ=270 | | |
| Θ=280 | | |
| Θ=290 | | |
| Θ=300 | | |
| Θ=310 | | |
| Θ=320 | | |
| Θ=330 | | |
| Θ=340 | | |
| Θ=350 | | |
| Φ=320 | | |
| Φ=330 | | |
| Φ=340 | | |
| Φ=350 | | |
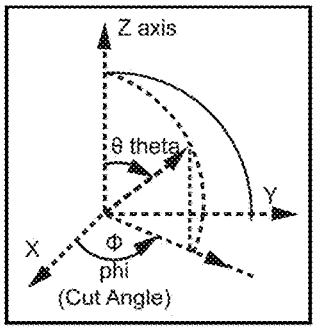
Title: 137x80x20 Wafer+Radome
Date: 9 Mar17
Comment Compact measutement Mushroom vs Wafer ϕ = 90deg 1.2m dia GND
| Φ = | 90 | |
|---|---|---|
| MaxGain= | 7,8 | [dBi] |
THETA in [Z-X/Y] Plane
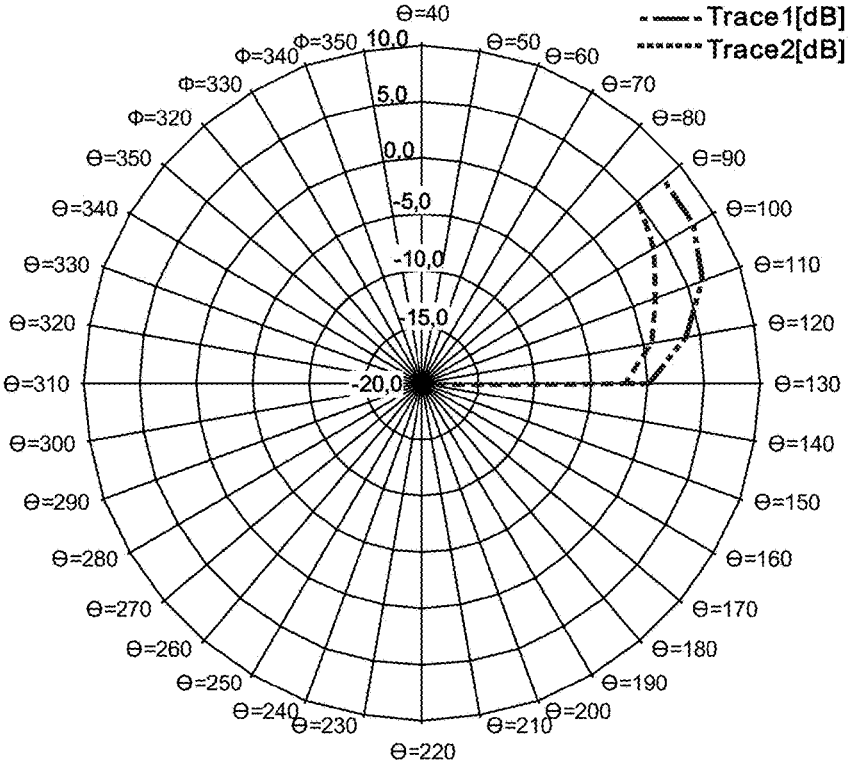
(ii) - Wafer with 20mm P.E.S. radome. Elevation, Long-side vs mushroom.
FIG. 18 (ii)

| ϕ = Mushroom | | 0 |
|---|---|---|
| Set | Read | Read |
| | Trace1 [dB] | Trace2 [dB] |
| Θ=0 | | |
| Θ=10 | | |
| Θ=20 | | |
| Θ=30 | | |
| Θ=40 | | |
| Θ=50 | 4,8 | 0,5 |
| Θ=60 | 3,6 | 0,0 |
| Θ=70 | 1,8 | -1,7 |
| Θ=80 | 0,6 | -3,4 |
| Θ=90 | -2,0 | -5,9 |
| Θ=100 | -20,0 | -20,0 |
| Θ=110 | -20,0 | -20,0 |
| Θ=120 | -20,0 | -20,0 |
| Θ=130 | -20,0 | -20,0 |
| Θ=140 | -20,0 | -20,0 |
| Θ=150 | -20,0 | -20,0 |
| Θ=160 | -20,0 | -20,0 |
| Θ=170 | -20,0 | -20,0 |
| Θ=180 | -20,0 | -20,0 |
| Θ=190 | | |
| Θ=200 | | |
| Θ=210 | | |
| Θ=220 | | |
| Θ=230 | | |
| Θ=240 | | |
| Θ=250 | | |
| Θ=260 | | |
| Θ=270 | | |
| Θ=280 | | |
| Θ=290 | | |
| Θ=300 | | |
| Θ=310 | | |
| Θ=320 | | |
| Θ=330 | | |
| Θ=340 | | |
| Θ=350 | | |
| Θ=350 | | |
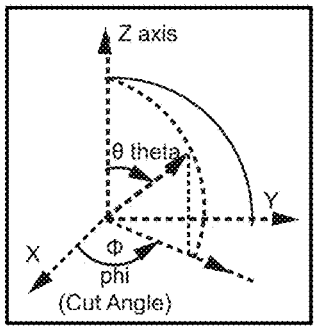
Title: 137x80x20 Wafer+Radome
Date: 9 Mar17
Comment Compact measutement Mushroom vs Wafer ϕ = 0deg 1.2m dia GND
| Φ = | Mushroom | |
|---|---|---|
| **MaxGain=** | **4,8** | **[dBi]** |
THETA in [Z-X/Y] Plane
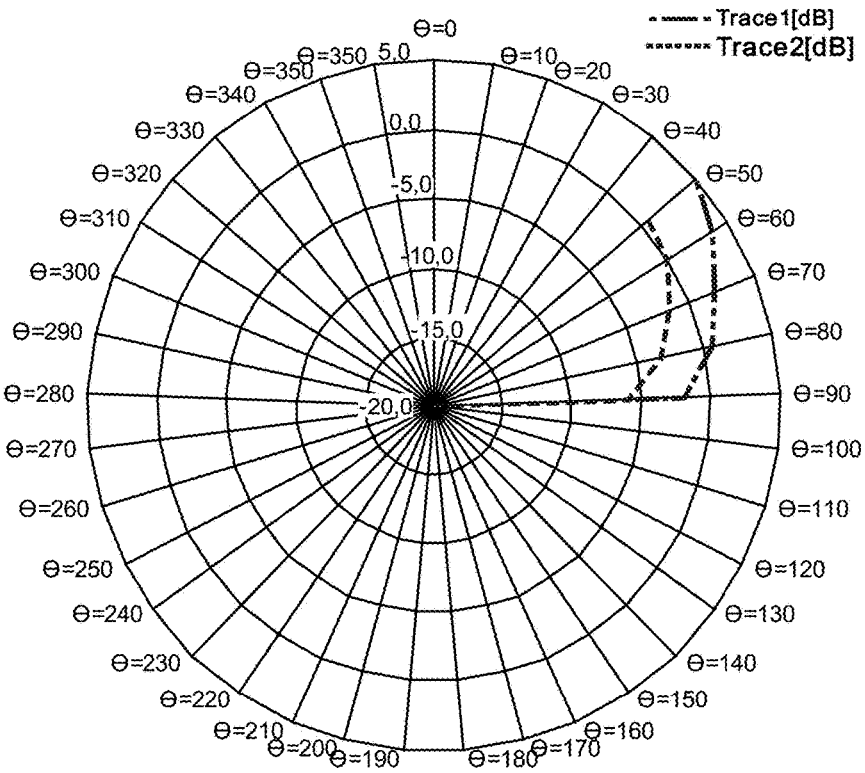
(iii) - Wafer with 20mm P.E.S. radome. Elevation, short-side vs mushroom.
FIG. 18 (iii)

ANTENNA

This application is a U.S. nationalization under 35 U.S.C. § 371 of International Patent Application No. PCT/AU2018/050259, filed Mar. 21, 2018, which claims priority to Australian Application No. 2017902047, filed May 30, 2017; the entire contents of each are incorporated herein by reference.

TECHNICAL FIELD

The present invention involves, among other things, an antenna with particular design and performance characteristics.

In some particular (albeit non-limiting) example applications, the antenna can be located on the surface of a road, a driveway, or the like, and can be used to perform radio-frequency identification (RFID) with RFID capable tags (RFID tags) which are located on the front and/or the back of passing vehicles. In this application (or like applications), the antenna would be a part of (or associated with) a RFID reader which is operable to communicate with RFID tags. Preferably, the RFID tags will be located on (or integrated as part of) the vehicles' license plates. More specifically, for vehicles which have a license plate on the front and the rear, a RFID tag will preferably be placed on (or integrated as part of) one or both of a said vehicle's license plates, or for vehicles which have only one license plate, a RFID tag will preferably be placed on (or integrated as part of) the single license plate.

Notwithstanding the foregoing, it is to be clearly understood that no particular limitations are to be implied from any of the example applications or uses mentioned above or discussed below. Thus, the antenna could potentially be used in a wide range of other areas and/or applications as well. By way of example, rather than being used in road applications for detecting RFID tags which are placed on the front and/or back of registered, road going vehicles (or on the vehicles' license plate(s)), the antenna could instead potentially find use on, say, goods or products which are moving past the antenna (e.g. goods or products being carried past the antenna by a machine, or on a conveyor, like in a factory or manufacturing facility, an airport baggage handling system, etc).

Nevertheless, for convenience, the invention will hereafter be described with reference to, and in the context of, the above road application where the antenna communicates with RFID tags which are located on (or integrated as part of) vehicle license plates.

BACKGROUND

For the purpose of providing a background and introduction to the present invention, reference is hereby made to the following earlier patent applications, namely:

- International Patent Application No. PCT/AU2015/050161 (hereinafter referred to as "patent application '161");
- International Patent Application No. PCT/AU2015/050384 (hereinafter referred to as "patent application '384"); and
- Australian Innovation Patent Application No. 2016101994 (hereinafter referred to as "patent application '994").

The entire contents of the earlier patent applications listed above are hereby incorporated herein by reference. Also, features, parts, components, design characteristics, methods, procedures, ways of doing things, options, possible alternatives, etc, described in the earlier patent applications listed above may also be used in or as part of the present invention, even if this is not expressly stated or described herein. However, in the event of (or to the extent of) any inconsistency or discrepancy between the disclosure in the present specification and the disclosure in any of the earlier patent applications listed above, the present specification takes precedence and overrides. Also, the mere incorporation herein of the contents of the earlier patent applications listed above does not mean that any express or implied restrictions or limitations on any inventions disclosed in any of those earlier patent applications, or that any express or implied restrictions or limitations on any other disclosure(s) given therein, necessarily also apply to the present invention or the disclosures herein.

In the context of road vehicle detection and identification through the use of RFID, patent applications '161, '384 and '994 explain (in varying degrees of detail) that there are a number of significant benefits and advantages that can arise from placing an RFID tag fairly low-down on a vehicle (i.e. quite close to ground/road height), preferably by placing a tag on one or both of the vehicle's license plates (or by embedding a tag in one or both of the vehicle's license plates thereby making the license plates "smart" plates), and also from enabling the said RFID tag(s) to be read by an RFID reader, the antenna of which (at least) is placed on or in the road.

It is to be noted that the proposal in the previous paragraph, namely placing RFID tags low on vehicles (preferably by having the tags on or embedded in license plates) and enabling the tags to be read by an RFID reader which has (at least) its antenna placed on or in the road, represents a major departure from the design and thinking behind conventional RFID systems used for vehicle detection, identification and/or monitoring. Indeed, in most conventional RFID-based vehicle detection, identification and/or monitoring systems, an RFID tag is installed on the inside of a vehicle's windscreens (i.e. quite high up on the vehicle), and the RFID tags on the vehicles are read by RFID readers mounted (very often) "overhead", generally on over-road gantries or the like. These conventional systems incorporating windscreen-mounted RFID tags and over-road or gantry based RFID reader placements suffer from numerous disadvantages, as discussed more in patent application '161 especially, but also in patent applications '384 and '994. However, of the many disadvantages, one of the most significant is quite simply the cost associated with over-road gantries, both in terms of the cost of producing the gantries themselves (they are large metal structures), and also in terms of costs associated with erection of the gantries over the roads, and the installation of the RFID reader equipment thereon, etc, as well as any subsequent maintenance or repair of the gantry and/or reader equipment thereon, all of which generally require partial or complete closure of the road (which is in turn extremely disruptive and expensive in itself, quite apart from the actual costs associated with the maintenance or repair).

The patent applications referred to above variously describe designs and configurations of certain antennas, and RFID readers incorporating said antennas, that may be capable of on-road or in-road installation or deployment and which may also be suitable (when installed/deployed on or in the road) for reading RFID tags on passing vehicles' license plates, including on freeways or other roads with high (or potentially high) vehicle speeds. The antennas and RFID readers described in those patent applications, and other associated disclosures therein, therefore provide a possible alternative to conventional RFID systems, including in particular in freeway and open road scenarios, which rely on over-road gantries and the like. Use of the antennas described in those patent applications may therefore allow a number of the major disadvantages associated with over-road gantries or the like, including (in particular) the cost thereof, to be avoided or reduced, whilst still allowing vehicle detection and identification, etc, using RFID.

For the purposes of the present introduction, it is to be noted that, where an antenna is installed/deployed on or in the road and is to be used for reading RFID tags on passing vehicles' license plates, particularly on freeways or other roads with high (or potentially high) vehicle speeds (and it is believed that certain antennas described in the patent applications above are suitable/capable of use in these kinds of high-speed applications), there is a required read zone for the antenna which is actually quite specifically defined in terms of its size and shape. In other words, there is a region of quite specific size and shape near the RFID reader antenna inside which the RFID reader is required to be able to communicate with a vehicle's plate-mounted RFID tag if (or whenever) a vehicle's tag is within the said region. The reason this required read zone (region) is quite specifically defined in terms of its size and shape is due to a number of factors, including: the placement location and orientation of license plates on vehicles, the dimensions (especially the width) of road lanes, the typical maximum speed of travel of vehicles (especially on freeways and other high (or potentially high) speed roads), and the time required for an RFID reader to reliably "read" (i.e. detect and positively identify) a vehicle's (plate-mounted) RFID tag. This is explained further below.

(Note: the passages that follow immediately below are quoted from patent application '384. However the passages below have also been edited slightly, where necessary, to make sense in the context of the present introductory discussion, and also to refer to Figures in the present specification rather than to the (essentially equivalent) Figures in patent application '384):

In normal conditions, bearing in mind radio properties, interference, the need for data loss retries, etc, it is thought that vehicle identification using passive UHF RFID requires approximately 80 ms to reliably exchange 512 bits of identification data. In this regard, 512 bits of data is thought to be enough to identify a vehicle and perform [at least] a rudimentary offline verification of that identity. A vehicle travelling at 36 km/h will travel 0.8 m in 80 ms, and a vehicle travelling at 180 km/h will travel 4 m in 80 ms. Therefore, for the purposes of the present discussion [and this is also applicable here], 4 m of vehicle travel will be used as [and it will be assumed to be] the minimum exposure required to reliably read a RFID tag on a moving vehicle. Those skilled in this area will recognise that this is based on an assumption of a maximum vehicle speed of 180 km/h, which seems reasonable given that vehicles will very rarely (if ever) travel faster than this on public roads.

[FIG. 5] illustrates . . . the read-zone [near the RFID reader antenna within which] vehicles equipped with RFID enabled license plates [must be "read", i.e. detected and identified]. The [width of the road lane, and hence the width of the] RFID enabled plate travel path in [FIG. 5] is 4 m wide with the read-zone starting at 5 m before the reader antenna and ending at 5 m beyond the reader antenna (the reader in this instance is located in the centre of the road lane . . . ). The space from 1 m before to 1 m beyond the reader antenna is excluded from the read-zone in an attempt to reduce the blinding effect of radiation reflection [from the undersides of vehicles as they pass directly over the antenna, as discussed further in application '384]), and also because of angled-read problems that may arise in this region, especially for vehicles (and the plates thereof) which are moving near the side of the lane (rather than down the centre of the lane directly in line with the reader).

The typical values for the parameters in [depicted in FIG. 1 and FIG. 5] are: L=1 m, Lx=4 m, Ly=2 m and 200 mm≤h≤1200 mm [or 300 mm≤h≤1300 mm].

[FIG. 5] illustrates the effective read-zone [9] for a RFID tag . . . located on a vehicle license plate, as read using an in-road RFID reader . . . . The required read-zone [or required read-region, 2, which is also illustrated in FIG. 1], covers the typical lane width of [2Ly=] 4 m and the required 4 m "in-beam" travel path (Lx) . . . . The RFID reader's (wide and flat) "dropped doughnut" shaped radiation pattern (this being a highly preferable shape for the radiation pattern [as shown in FIG. 2]) is represented in [FIG. 5] by the circle labelled [3]; [I]t will be understood that [even though this radiation pattern shape] . . . is represented [merely] as large a circle [3] in [FIG. 5]), [nevertheless this circle 3 in FIG. 5] is actually [representative of] a dropped-doughnut-like or squashed-toroid-like radiation pattern preferably having a shape approximating the one shown in [FIG. 2]. In any case, the RFID reader's radiation pattern [3], with a face-on read range of approximately 6 m, combined with the effect of the angle of read on the plate's RFID tag, results in the illustrated effective . . . read zone [9]. The effective . . . read zone [9] is the area in which a RFID tag which is on/in a vehicle license plate will receive enough power from the RFID reader to be switched on and effectively reflect a modulated signal. As shown in [FIG. 5], the effective read zone [9] is roughly "FIG. 8"-shaped, with the centre of the FIG. 8 located at the position of the RFID reader and the two lobes of the "FIG. 8" [projecting] on either side thereof in the direction of vehicle travel. (It should of course be recalled that the RFID reader's antenna . . . is non-directional and therefore the orientation of the "FIG. 8" shaped effective read zone [9]—i.e. in line with the vehicle's direction of travel—arises due to the geometry of the required read zones [2], and the convergence of the "FIG. 8" lobes near the reader arises due to angle of read issues. These factors concerning the orientation of the "FIG. 8" shaped effective read zone [9] are therefore not a result of the design/configuration of the [RFID reader] antenna itself).

Patent applications '384 and '944 (at least) therefore explain that a required read-zone (i.e. the region near the RFID reader antenna inside which the RFID reader is required to be able to communicate with a vehicle RFID tag if said tag is within said region):

is approximately 4 m wide (2 m laterally on either side of the antenna)—this corresponds generally to the maximum width of most road lanes, occupies the space from about 5 m to about 1 m before the antenna in a given direction (e.g. the direction of travel in a road lane) and also the space after the antenna (in the said same direction) from about 1 m to about 5 m after the antenna—the 1 m immediately before and after the antenna is not included in the required read zone due to potential blinding and angle of read difficulties in this region, but otherwise this 5 m to 1 m before, and the 1 m to 5 m after, the antenna allows, both before and after the antenna, 4 m of vehicle travel within which to "read" the tag, and 4 m is the distance travelled in the time required to perform the "read" if the vehicle is travelling at a maximum assumed vehicle speed (180 km/h), and extends in height, at least within the horizontal zones defined in the preceding bullet points, from between about 0.2-0.3 m and about 1.2-1.3 m above ground (road) level—this height range corresponds to the range of heights above the ground at which license plates (and hence the RFID tags incorporated therein or provided thereon) are mounted on most road going vehicles.

Notably, the gap between moving vehicles on a road is typically at least one vehicle length, which is on average is about 6 m. The gap between vehicles is very seldom, and generally only in very slow moving scenarios, less than 4 m. This provides ample time to read the front plate of a following vehicle and the rear plate of a leading vehicle. Note: these respective plates will not be time in the read-zone at the same. This geometry limits the amount of RFID tags in the read-zone. It should also be noted that RFID tags are now used to mark vehicle components and other articles, e.g. pallets, containers, gas cylinders . . . . All of these tags, and the objects to which they are attached, are placed on vehicles. These tags will also be in the radiation of an overhead gantry reader and side reader. They will therefore interfere with the reading of the tag on the plate where overhead gantry readers and side readers are used. These tags generally will NOT, however, be in the beam of a reader on/in the road. A reader on/in the road will therefore be less disturbed by other tag in and on a vehicle.

For further illustration, and for the avoidance of any doubt, the required read-zone described in the bullet points above is illustrated in FIG. 1. In FIG. 1, the required read-zone is again indicated by reference numeral 2. Note that the dimensions of the required read-zone given above may not precisely match the required read-zone dimensions discussed in patent applications '161, '384 and '994. Nevertheless those earlier patent applications clearly disclose a required read zone which is at least similar to that given above, even if the zone dimensions quoted differ slightly.

To achieve an effective read zone that covers or encompasses the required read-zone just described, one means that was previously considered desirable, as discussed in patent applications '161, '384 and '994, was by using an omnidirectional (in the azimuth), vertically polarised radiation pattern, and hence by using an RFID reader antenna able to provide such a radiation pattern.

More specifically, it was previously thought desirable, as patent applications '161, '384 and '994 explain, that the radiation pattern 3 of the RFID reader antenna should preferably have a shape that might be described as a "dropped doughnut" or "squashed toroid"—that is, a shape as shown pictorially in FIG. 2.

RFID tag antennas such as, in particular, the antennas of RFID tags used on vehicle license plates (which might often be simple slot antennas or the like, although a range of other antenna types may also be used) typically have a highly directional radiation pattern. (See FIG. 5 and FIG. 6.) More specifically, the radiation pattern of a RFID tag antenna on a vehicle license plate will almost invariably point generally in a direction 6 which is parallel to the license plate's "face-on" direction, albeit pointing away from the vehicle/plate, as depicted in FIG. 4. The direct radiation communication path 8 between the RFID tag antenna on the license plate and the RFID reader antenna (on/in the road) therefore has an elevation (i.e. height/vertical) offset 5, and it may also have a directional (horizontal) offset 7, from the plate's face-on direction. Whether or not there is a directional (horizontal) offset 7 depends on the travel path of the vehicle, and in particular whether the RFID tag antenna on the vehicle's license plate is passing directly over, or to one side of, the antenna. Both elevation and directional offset (but especially directional offset) can contribute to angle of read issues.

As will be evident from the above, FIG. 5 is a plan (i.e. "top down") view of a road comprising three road lanes. All three lanes in this example carry vehicles in the same direction, and all three are approximately 4 m wide. There is an RFID reader antenna placed on/in the road in the middle of the centre lane. FIG. 5 shows the following superimposed on the three-lane road:

the required read-zone 2 (square regions indicated by diagonal hatching);

an omnidirectional radiation pattern 3 of the RFID reader antenna—recall that "omnidirectional in the azimuth plane" is a radiation pattern shape characteristic that was previously thought to be most desirable for the RFID reader antenna; and the effective read-zone 9, which in the two-dimensional "top down" view in FIG. 5 has a "figure-8" shape (as a result of the overall geometry, including the geometry/shape of the required read-zone 2 and of the radiation pattern 3 which is omnidirectional (round) in this instance).

FIG. 6 is generally similar to FIG. 5, except that only a single road lane is shown, and the direction of vehicle travel in the lane happens to be opposite to the direction of vehicle travel shown in FIG. 5. However, one thing that is shown in FIG. 6 that is not shown in FIG. 5 is the approximate general shape of the radiation pattern of the antenna on an RFID tag on a vehicle's license plate (or at least a planform representation of the shape of this plate-tag antenna radiation pattern). The radiation pattern shape of the antenna on the RFID tag, i.e. the "tag antenna radiation pattern", is indicated by reference numeral 4 in FIG. 6. Whilst not the focus of the present invention (and in fact it is separate from, and unrelated to, the present invention), the shape of the plate tag antenna's radiation pattern is nevertheless very important in practical implementations of systems that use RFID for road vehicle detection and identification, because it is the interaction between radiation from the tag antenna and radiation from the RFID reader antenna (and the radiation pattern shapes for both of these respective antennas is hugely influential on this interaction) that facilitates the exchange of information, and hence the "read" of the plate RFID tag by the RFID reader. In any case, as should be evident from the radiation pattern 4 shown in FIG. 6, the RFID tag antennas used on vehicles' license plates will generally (if not invariably) be highly directional, pointing forward in (or parallel to) the license plate's direct "face-on" direction (this was also explained above and shown in FIG. 4).

Next, for the purposes of the present introduction, it should now be appreciated that, for "open road" and freeway applications, there is generally a need to be able to detect and identify a vehicle which could potentially be at any location within a road lane, including perhaps even at a position across or straddling multiple lanes if the road has more than one lane. What this means is that, in these kinds of "open road" and freeway applications, there is (or there may often be) a need to be able to detect and positively identify passing vehicles notwithstanding the fact that there is often considerable uncertainty as to the actual location of a vehicle (i.e. where the vehicle will actually be relative to the antenna) as the vehicle passes the antenna. This is at least part of the reason why, for a particular RFID reader antenna used for a particular road lane, the required read zone extends across the full width of the road lane, as depicted in FIG. 5 and FIG. 6. There may also be a need to be able to detect vehicles moving in different directions relative to the antenna, for example, if the antenna is placed at a crossroads or at an intersection where different vehicles may pass over or pass by the antenna while travelling in different directions. As a result of these things, RFID reader antennas which are capable of on- and/or in-road placement and which are suitable for reading RFID tags on passing vehicles' license plates on freeways or in other open road applications should generally have (or at least it is desirable for them to have) a radiation pattern that "points" in most, if not all, radial directions around the antenna. In other words, the RFID reader antenna's radiated energy should, it is thought, propagate to some extent in all radial directions (i.e. all horizontal directions, parallel to the road surface—in other words, in all directions in the azimuth plane). Actually, it was previously thought preferable for the antenna's radiated energy to propagate equally in all radial directions (i.e. equally in all horizontal directions, parallel to the road surface—or, in other words, equally in all directions in the azimuth plane). Thus, it was previously thought that (and this is what was proposed in patent applications '161, '384 and '994) the RFID reader antenna should preferably be omni-directional in the azimuth plane. This, however, has now been reconsidered somewhat, as discussed further below.

Another important consideration is that the amount of energy radiated by the RFID reader antenna in an "upward" direction (i.e. the amount of energy directed vertically upwards perpendicular to the surface of the road—or in other words the amount of energy directed at an upward angle of elevation relative to the azimuth plane) should be limited. There are a number of reasons for this, including limiting potentially "blinding" energy reflections from the undersides of vehicles that pass over the top of the antenna.

A further, practical issue that has been identified, and which it is thought may not be adequately addressed by the various antenna designs proposed in patent applications '161, '384 and '994, is the challenge that government and regulatory authorities and the like, and specifically those responsible for authorising the installation and/or use of any form of equipment (or objects of any kind) on or near public roads, are often highly conservative and therefore unprepared to authorise (or at least hesitant and highly wary of allowing) the installation and/or use of new types or forms of equipment which have not been used previously on public roads (like e.g. on- or in-road RFID reader antennas), particularly if the form (i.e. the size and/or shape and/or general configuration or appearance, etc) of the new equipment is unfamiliar, unconventional or different to types or forms of equipment that have previously been authorised for use, and in fact used, on public roads, and especially if the form of the new equipment is perceived to give rise to potential for risk or danger (even if it is only the smallest or most remote potential risk).

Yet another issue that has been identified, and which it is thought may not be adequately addressed by the various antenna designs proposed in patent applications '161, '384 and '994, is associated with the directionality of the RFID tag antennas used on vehicle license plates. For the avoidance of doubt, for most (if not all) kinds of antennas that are (or that may be) used in RFID tags on vehicles' license plates (these antennas might often be simple slot antennas, although a range of other antenna types may also be used), it is the nature of these antennas that they are known to be (inherently due to their design, placement and configuration) highly directional. In other words, these kinds of antennas emit radiation mainly in a direction directly away from (i.e. perpendicular to) the antenna's ground plane (which is parallel to the plane of the license plate), and the "spread" of the radiation in directions perpendicular/transverse to this "straightforward" direction, and especially in directions perpendicular to the "straightforward" direction and parallel to the road surface, is relatively low. Thus, these kinds of antennas generally have (due to their inherent configuration) a radiation pattern shape that is narrow and forward pointing, like the radiation pattern shape 4 shown in FIG. 6.

However, something that has now been identified is that, when these kinds of RFID tag antennas are used on license plates and especially where those license plates are in turn mounted on vehicles that have a large (or bluff) metal front, e.g. like buses, trucks, some military vehicles, and even some vans and 4WDs/SUVs, etc, the radiation emitted by the on-plate tag antenna can sometimes become, in effect, even more directional. Consequently, the shape 4 of the radiation pattern produced by RFID tag antennas used on license plates that are mounted on such vehicles with large (or bluff) metal fronts can become, in effect, even narrower and more forward-pointing/focused. (Incidentally, it is thought that at least part of the reason for this is that the large (bluff) metal vehicle front functions, at least somewhat, as a de facto ground plane of increased size (or an extension/expansion of the actual ground plane) for the RFID tag antenna on the plate.) In any case, this increased directionality of the on-plate tag radiation can in turn have the consequence that, for example, if the radiation pattern of the RFID reader antenna that is to "read" the plate's RFID tag has a completely omnidirectional shape (3) (i.e. extending equally in all radial directions, which is what is proposed in patent applications '161, '384 and '994), the combined effect of these geometries of the narrower RFID tag antenna radiation pattern and the RFID reader antenna radiation pattern, respectively, and the interaction between them, can be that the effective read zone 9 can sometimes no longer extend all the way across the road lane, and therefore (where this occurs) it may not quite cover the entire required read zone 2, as shown in FIG. 7(*i*). Thus, where this occurs, the effective (i.e. actual) read zone 9 may not cover the whole of the required read zone 2 (e.g. there may be portions of the required read zone 2, particularly near the edges/peripheries thereof (near the lane edge(s)), which the actual read zone 9 does not cover), meaning that it may be possible for a passing vehicle to avoid detection/identification (or miss being detected/identified), say, if the RFID tag antenna on the plate passes through one of these peripheral areas of the required read zone 2, or if the RFID tag antenna on the plate is not within the effective/actual read zone 9 for enough time for an complete "read" to be achieved.

To help accommodate for this, it has now been recognised that it may (at least in some circumstances/situations) be desirable to make the RFID reader antenna's radiation pattern shape extend further in one or some horizontal directions than others, or in other words for the extent of the RFID reader antenna's radiation pattern to be greater in one or some directions than others in the azimuth plane (i.e. radially around the antenna, parallel to the road surface). It is hoped that the present invention may provide a means by which this may be made possible. In particular, it may sometimes be desirable for the RFID reader antenna's radiation pattern 3' to extend further across the road (or more in a direction perpendicular to the direction of vehicle travel on the road), with the effect that (as a consequence of the respective geometries of the RFID tag antenna radiation pattern (discussed above) and the RFID reader antenna radiation pattern, and as a result of the interaction between the two) the effective read zone 9' again covers the full road lane (and hence covers the entire required read zone 2), as shown in FIG. 7(*ii*), despite the increased directionality of the tag antennas' radiation.

Another possible reason why it might be desirable to make the RFID reader antenna's radiation pattern shape extend further in one or some horizontal directions than others, and in particular for the radiation pattern to extend further in a direction perpendicular to the direction of vehicle travel on the road than it does in a direction parallel to the direction of vehicle travel, as shown (albeit in an exaggerated and simplistic two-dimensional way) in FIG. 7(*ii*) is to thereby make it more difficult for vehicles (and their drivers) to avoid detection by "driving around" the antenna (or by driving along a path/trajectory past the antenna that is a sufficient lateral distance to one side or other of the antenna), which drivers might do to try and avoid being within the antenna's radiation pattern for enough time for a complete/successful "read" to be achieved.

A further problem with using an RFID reader antenna that provides a radiation pattern that is omnidirectional in the azimuth plane (i.e. like the "dropped toroid" radiation pattern depicted in FIG. 2), and in particular with using multiple such antennas at the same location, is potential crosstalk at the RFID tag on a vehicle. This crosstalk may occur when a vehicle drives between the lanes, i.e. between two reader antennas, as depicted in FIG. 3. In arrangements such as this, the effective read zones of the respective readers/antennas may often be designed to overlap to detect vehicles driving between lanes to avoid detection. However, in this arrangement, it may be possible that two readers will transmit a data messages at the same, which will confuse a single tag (i.e. in a single vehicle) which is at equal (or approximately equal) distance from the two antennas. See FIG. 3(*i*). One possibility for solving (or reducing) this problem, if an RFID reader antenna that provides a radiation pattern that is omnidirectional in the azimuth plane (i.e. like the "dropped toroid" radiation pattern) it is still to be used, is to stagger the antennas, to try and create enough separation to avoid cross talk. This staggered separation may result in a diagonal separation to the drive path, therefore lane splitters (a vehicle driving between lanes) will still be detected, as shown in FIG. 3(*ii*).

A possible alternative option for solving or addressing the problem discussed above with reference to FIG. 3(*i*) may be to, again, make the RFID reader antenna's radiation pattern shape extend further in one or some horizontal directions than others, or in other words for the extent of the RFID reader antenna's radiation pattern to be greater in one or some directions than others in the azimuth plane (i.e. radially around the antenna, parallel to the road surface). In particular, in this situation (and this is in contrast to the situation described with reference to FIG. 7(*ii*) above), it may be desirable for the RFID reader antenna's radiation pattern 3" to extend (at least somewhat) further along the road (or at least some more in a direction parallel to the direction of vehicle travel on the road). Where this is done (and it is thought that the present invention, or variants thereof, could potentially provide a means by which this may be achieved, or which may move towards this), it may further be possible to use selective feeding (potentially including non-central feeding) to thereby cause the long axis of the radiation pattern shape (in the azimuth plane) to point diagonally left or right, as shown in FIG. 8(*i*). An intelligent time division multiplexing method may then be employed to point the beam diagonally left and right, in a rapidly switching manner, to find a tag. The multiplexing method may further lock on a tag (once detected) until the tag is fully interrogated and then resume the multiplexing. The multiplexing needs to be in sync as between multiple nearby RFID reader antennas (see FIG. 8(*ii*)). The different readers may, in fact, be able to detect the multiplexing of adjacent readers, even though the signal strength from the adjacent readers may be very low As mentioned above (albeit without limitation), for design purposes, an assumption is often made that on freeways and open roads, vehicles may be travelling up to (or around) 180 km/h, or at least at speeds of this order. As a result of the potentially high vehicle speeds on freeways and other open roads, it is often the case that a vehicle that is passing an RFID antenna on a freeway or open road, and whose plate-mounted RFID tag must be read by the RFID reader associated with the antenna, will only be in the antenna's "read zone" for a very short period of time (due to the speed at which the vehicle moves past the stationary antenna). It is explained above that: (roughly) 80 ms is thought to be required in order to "read" the plate-mounted tag; a vehicle travelling at 180 km/h travels 4 m in 80 ms; and therefore a required read zone of 4 m is needed to enable successful "reads" of the RFID tags on vehicles, given that the vehicles may be passing the RFID reader antenna at speeds of up to 180 km/h (this being a maximum speed assumed for design purposes, although in reality vehicle speeds will rarely if ever be this high). Actually, as explained above, the required read zone should include 4 m before, and 4 m after, the antenna, but not include the region 1 m immediately before and 1 m after the antenna (where blinding and/or angle of read issues may prevent reliable read). Accordingly, in the direction of vehicle travel, the required read zone should cover the regions from 5 m to 1 m before the RFID reader antenna, and from 1 m to 5 m after the RFID reader antenna. In order for the radiation pattern of the RFID reader antenna to "cover" these required regions, the power with which energy is radiated from the RFID reader antenna should be sufficiently high in order to do so.

It was also mentioned above that it has now been recognised that it may be desirable to make the radiation pattern shape extend further across the road than, say, the radiation pattern 3 of the RFID reader antenna shown in FIG. 5. From the discussion in paragraph, it might initially be thought that making the radiation pattern shape extend further across the road may be simply a matter of increasing the power supplied to the RFID reader antenna (this would actually increase the extent/size of the radiation pattern in all directions). However, simply increasing the power supplied to the RFID reader antenna is not always viable, or even permitted. For one thing, there may be limits on the amount of power that can be supplied to the antenna, e.g. due to limits on the power that can be easily transmitted to the antenna's on- or in-road location, or perhaps due to limits on the amount of power a battery can supply if it is to have a life or re-charge interval that is not too short, etc. Also, in many jurisdictions there are laws or regulations which place restrictions on the amount of power that a radio antenna (including an RFID antenna intended for vehicle detection/identification use)

may emit. These things, for example, therefore often place restrictions on the amount of power that may be supplied to the on- or in-road antenna. However, even aside from the above, there are also practical reasons why increasing the power supplied to an RFID antenna, particularly one that is located on or in the road and used for vehicle detection and identification, is undesirable. For example, it was mentioned above that the amount of energy radiated in an "upward" direction from an on- or in-road antenna (i.e. the amount of energy directed vertically upwards perpendicular to the surface of the road) should be limited, largely so as to limit "blinding" reflections from the underside of the vehicles. Simply increasing the amount of power supplied to an on—or in-road RFID antenna used for vehicle detection/identification would not only increase the size of antenna's radiation pattern in a radial direction (parallel to the ground), but it would also increase the strength (or power or power density) of the radiation pattern (i.e. increase the amount of radiated power) that is directed in the vertically upward direction (perpendicular to the ground), which would be counter-productive because it would increase the potential for undesirable "blinding" reflections from the undersides of vehicles (among other things). Furthermore, increasing the amount of power that is supplied to an RFID antenna would also likely increase the amount of heat that is generated, not only by the antenna itself, but also (and often much more so) by the associated RFID reader equipment which supplies the power to the antenna (among other things). The amount of heat generated by the antenna and associated RFID reader equipment can be extremely important, especially in scenarios where an RFID reader is (or parts/components of it are) installed "in-road" because, due to the location and environment in these installations scenarios, there is often very limited possibility for ventilation or other means of heat dissipation. Consequently, minimising the amount of heat that is generated by the antenna and any associated RFID reader (or other) electronics in the first place becomes very important, because the difficulty in ventilating or dissipating heat means that if too much heat is generated in the first place then there may be a danger of overheating the antenna and/or electronics (which may in turn lead to damage or overheating prevention shutdown, if not actual overheating or damage).

Patent applications '384 and '994 disclose certain antenna designs having configurations which are intended to, among other things, help overcome a number of challenges associated with the changeable (and often drastically and dynamically changeable) radio frequency (RF) transmission conditions/environment that exist in the vicinity of the antenna, including due to the "near ground effect". Indeed, it is specifically explained in patent application '384 that:

> [t]he "near ground effect" is the ground effect caused by the ground (which is part of planet Earth), or by the surface on which the antenna is mounted, in the immediate vicinity of the antenna (e.g. within about 6 m or about one typical vehicle length from the antenna). This "near ground effect" (i.e. the ground effect from the "near ground") in particular may be highly variable and even dynamically variable (i.e. subject to change with time and/or due to changes in conditions, etc) . . . .
>
> While discussing the ability of the . . . antenna to help compensate/account for the ground effect, and especially the near ground effect, it is useful also to . . . emphasise certain other/related points which are important insofar as the . . . antenna and its operation in [the presently-considered on/in road] applications are concerned. A first point is that, when an antenna . . . is [positioned on/in the road and] used in, for example, a vehicle detection and/or RFID vehicle identification application, the antenna is effectively being used in a way that may be considered generally similar or analogous to an antenna in a RADAR transmitter/sensor. Indeed, . . . RADAR essentially involves a radio signal that is first transmitted by a sensor; that radio signal is then reflected by the object to be observed, and the reflected signal is received and interpreted by the sensor (e.g. for the purpose of detecting the presence of the object, and/or its location and/or movement relative to the sensor, etc). In the case of RFID, a signal may be emitted by an RFID reader (which includes an antenna . . . ), and a "reflected" signal may then be sent back from e.g. an RFID tag on a vehicle, back to the RFID reader. In RFID, both of these signals (i.e. both the signal emitted by the RFID reader and also the "reflected" signal sent back from the RFID tag to the RFID reader) can be modulated to carry information/data (this modulation of data onto the signals is at least part of what distinguishes RFID from traditional RADAR wherein the signals are unmodulated). In other words, in RFID, information can be modulated onto the signal emitted by the RFID reader such that information is sent from the reader to the tag, and similarly information can be modulated onto the signal sent (reflected) by the RFID tag such that information is sent back from the tag to the reader. Where there is this kind of two-way data exchange, and specifically in RFID vehicle identification applications, the exchange of information may be used to perform (and in fact this may be what makes it possible to perform) the [positive] identification (i. e. ID detection/recognition) of a specific vehicle . . . . Alternative arrangements or situations may also be possible where the signal emitted by the RFID reader and the "reflected" signal sent back from the RFID tag to the RFID reader, or one of them, is/are unmodulated, such that there is therefore no two-way data exchange like that just described above. However, even in this alternative case where the signal emitted by the RFID reader and/or the "reflected" signal sent back from the RFID tag to the RFID reader is/are unmodulated, nevertheless the signal sent by the RFID tag, which is still received and interpreted by the reader, may still be used for vehicle detection, among other things. Indeed, when such a reflected signal, which is sent (reflected) back from an RFID tag, is received by the reader, this signal (even if it is an unmodulated signal) may immediately signify the presence of a RFID tag (and hence a vehicle) within the read range of the reader (although which specific vehicle it is—i.e. the specific vehicle identity/ID—may not in this case be determinable, at least not from the signal sent by the RFID tag alone). Furthermore, the way the said signal changes with time (i.e. the way the signal which is sent from the RFID tag and received by the reader changes with time, even if it is an unmodulated signal) may be used (interpreted by the reader) to ascertain information about the (non-identified) vehicle in addition to merely its presence. Indeed the location and movement of the vehicle—e.g. its distance or position relative to the reader, its speed (and possibly direction) of travel, etc—may possibly be determined. It will be appreciated that this last unmodulated-signal scenario is somewhat more akin to traditional RADAR [than the two-way data exchange scenario in which positive vehicle identification is achieved using RFID].

Another point that should be emphasised is that, whilst antennas . . . , when used in e.g. vehicle detection and/or RFID vehicle identification applications, may be used in a similar or analogous way to traditional RADAR antennas (see above), nevertheless at the same time, the region within which [a RFID reader antenna used in the presently-considered on/in road applications] needs to operate, and the required transmission ranges, radiation pattern shapes, and even the physical position of the antenna (and hence the physical location in which, and from which, the antenna's signal is transmitted) may all be vastly different to antennas used in conventional RADAR. Indeed, for reasons explained in detail [in patent applications '161 and '384, RFID reader antennas used in the presently-considered on/in road applications] will often need to be located at ground level, typically on or in the surface of the ground (i.e. on or in the surface of planet Earth)—e.g. on or in the surface of a road. So, the antenna will generally need to be configured to be positioned at (and such that its signal radiation is emitted from) ground level on planet Earth. This is very different to conventional RADAR wherein traditional RADAR antennas are almost always located well above ground level, typically at least 2 wavelengths above the ground (i.e. the height from which a conventional RADAR antenna operates is generally at least twice the wavelength of the RADAR signal it transmits). Accordingly, traditional RADAR antennas are generally not required to accommodate much (if any) change in signal transmission propagation conditions due to the "near ground effect". Rather, for them, the effect on signal transmission propagation caused by planet Earth [and in particular the changing conditions/environment on planet Earth] may often be assumed negligible or at least constant, e.g. regardless of any time and/or position variant changes in weather or ambient conditions or ground conditions etc. This is very different to the [RFID reader antennas used in the presently-considered on/in road applications] which must operate on/in the ground and where the effect on signal transmission propagation caused by the ground [and in particular the changing conditions/environment] on/in which the antenna is located (especially the near ground) can change drastically both between different locations and also dynamically at the same location . . . [For example] signal transmission propagation conditions can change drastically with time even at a single location, e.g. with changes in surface conditions due to surface water vs dry, wet soil vs dry in the vicinity, [etc. Signal transmission propagation conditions can also change drastically between different locations due to such things as] the presence or absence of metal or other conductors in the road base, substances of different conductivity like paint or oil on the road, etc) . . . .

Furthermore, traditional RADAR antennas generally have a very focussed/directional radiation pattern intended to transmit over large or very large transmission distances (typically in a broadcast manner). So, not only are conventional RADAR antennas normally positioned well above ground level, but they have narrow focussed/directional radiation patterns and transmit over large distances (i.e. they operate in what is often termed the far field—a.k.a. the Fraunhofer region). In contrast, [the RFID reader antennas used in the presently-considered on/in road applications] may (and typically will) need to transmit over and within a range that is very much closer to the antenna, possibly even within the antenna's radiating near field a.k.a. Fresnel region. Furthermore, antennas in accordance with embodiments of the present invention may (and typically will) need to provide a radiation pattern that is non-focussed, and which extends further in a direction parallel to the plane of the [antenna's] ground plane than it does in a direction perpendicular to the plane of the [antenna's] ground plane [as discussed above and also in patent applications '161 and '384]. By way of illustrative example . . . , [for an] antenna . . . configured to operate with signals of frequency around 1 GHz (and hence with signal wavelengths of about 300 mm), the antenna, which is part of an RFID reader located on/in the road surface, may be used to (so to speak) "radar" detect and/or identify one or more vehicles within a radius of about 5 or 6 m around the antenna, where the RFID tag(s) on the vehicle(s) is/are at or below a height of about 2 m.

In summary, patent applications '384 and '994 refer to certain antenna designs (and antenna design methodologies) which are intended to help overcome a number of the issues and challenges just described in the quoted passages above, particularly where (modulated and/or unmodulated) RADAR or RADAR-like transmission is the data transfer method used and with the transmitting antenna on the ground and the reflecting antenna within ~6 m and below.

Also, as has been explained earlier, in the context of RF road vehicle detection/identification applications, there are numerous advantages that arise from placing the RFID reader, or at least the antenna thereof, on or in the road surface. However, as has further been explained just above, the placement of the antenna on/in the road surface, especially where the required read range is within 6 m from the antenna, limits (or it may entirely prevent) the use of conventional radar radiation methods in which the Earth in particular is often quantified as (i.e. it is assumed to be) a single RF element which is homogeneous and stable/non-changing/time-invariant (or almost so).

Those skilled in the area of antenna design will recognise that whilst conductivity (including, but not limited to, road-surface conductivity) is one of the important parameters which can influence the radiation pattern of an on-road or in-road antenna, it is not the only relevant parameter. For instance, as another example, in road building, a range of different types of aggregates may be used. The way in which these different types of aggregates age, change, bind, compact, etc, over time differs. The numerous potential effects of this (including differing material makeup, density, porosity, surface shape and texture of the road surface, etc) can also significantly affect the radio frequency transmission conditions/environment on the road, which in turn also influences the radiation pattern of the on/in road antenna.

It is thought that it might be desirable if there were a method and/or appropriate antenna hardware/apparatus that could accommodate the potentially widely and dynamically variable radio frequency transmission conditions/environment that may exist on a road at different times, or on different roads at different locations at different times, so as to enable an antenna that can be placed on/in a road, or antennas that can be placed on/in roads at different locations, to achieve a desired antenna radiation pattern consistently (or at least with an acceptable degree of consistency) in all conditions at all locations. It may be particularly desirable if the tuning of in-road or on-road antennas could be made (or if it could become) a more "exact science"—that is to say, if antenna tuning could be performed in such a way that the effect on the antenna's radiation pattern resulting from tuning alterations to the size, design, configuration, etc, of the antenna (or of certain parts of the antenna) is much more predictable and reliable and therefore much less reliant on simple "trial and error" tuning.

Even though considerable introductory discussion and background information is provided above, it is to be clearly understood that mere reference in this specification to any previous or existing antenna designs, devices, apparatus, products, systems, methods, practices, publications or indeed to any other information, or to any problems or issues, does not constitute an acknowledgement or admission that any of those things, whether individually or in any combination, formed part of the common general knowledge of those skilled in the field, or that they are admissible prior art. Also, the mere fact that something is mentioned or discussed in the Background section above does not necessarily mean that it was publicly known (or known at all) prior to the present invention. Indeed, the Background section above may well also contain explanations relevant to the present invention, its features, characteristics, possible implementation, possible options, alternatives or variants, its uses, etc, including some of which may not also be repeated anywhere else in this specification.

SUMMARY OF THE INVENTION

In one form, the present invention relates broadly to an antenna for a communication device, the antenna having a structure including a ground plane and a lid component, wherein:

the lid component is conductive, substantially planar and has a planform shape (i.e. a shape which when viewed in orthographic projection) which is lesser in a first lid component dimension ($L_1$) than it is in a second lid component dimension ($L_2$) perpendicular to the first lid component dimension ($L_1$) (i.e. $L_1 \perp L_2$ and $L_1 < L_2$), the ground plane is conductive, substantially planar and has a planform shape (i.e. a shape which when viewed in orthographic projection) which has a first ground plane dimension ($G_1$) and a second ground plane dimension ($G_2$), where the first and second ground plane dimensions ($G_1$ and $G_2$) are parallel to the first and second lid component dimensions ($L_1$ and $L_2$) respectively, the size of the ground plane in the first ground plane dimension ($G_1$) is greater than the size of the lid component in the first lid component dimension ($L_1$) and the size of the ground plane in the second ground plane dimension ($G_2$) is greater than the size of lid component in the second lid component dimension ($L_2$), and the lid component is conductively connected to the ground plane but also spaced apart from the ground plane such that there is a space (also referred to as a "cavity") between the lid component and the ground plane, and the antenna is center fed. (In this regard, center fed means (or it at least includes) that a feeder (i.e. like a feeder cable, conductor or similar) connects at a geometric center of the planar lid component, this being a location that corresponds to a null or virtual null in the lid component.)

In another, slightly different form, the present invention relates broadly to an antenna for a communication device, the antenna having a structure including a ground plane and a lid component, wherein:

the lid component is conductive, substantially planar and has a planform shape which is lesser in a first lid component dimension ($L_1$) than it is in a second lid component dimension ($L_2$) perpendicular to the first lid component dimension ($L_1$) (i.e. $L_1 \perp L_2$ and $L_1 < L_2$), the ground plane is conductive and substantially planar, where the size of the ground plane is greater than the size of the lid component;

the lid component is conductively connected to the ground plane but also spaced apart from the ground plane, such that there is a space (also referred to as a "cavity") between the lid component and the ground plane, and the antenna is center fed. (Again, center fed means (or it at least includes) that a feeder (i.e. like a feeder cable, conductor or similar) connects at a geometric center of the planar lid component.)

The lid component may be spaced apart from but also (at least approx) parallel to the ground plane.

It is mentioned in connection with both forms of the invention described above, that the lid component is, inter alia, conductive. However, despite this, it will generally (if not always) be the case that when the antenna is in operation, the lid component is (at least mostly) non-radiating. In other words, it will generally (if not always) be the case that little (if any) of the electromagnetic radiation, EMR, emanating from the operating antenna (which will typically be radio frequency, RF, radiation, given the present "RFID" application) is radiated by the lid component. Instead, the way in which energy is radiated by the antenna will be ascribed further below.

Following on from the above, it is thought that in most (if not all) embodiments of the invention, energy/radiation (EMR, which will typically be RF given the present RFID application) radiated/emitted by the antenna will emanate from between the lid component and the ground plane. More specifically, it is thought that in most (if not all) embodiments of the invention, energy/radiation radiated/emitted by the antenna may emanates (at least mostly) from between the ground plane and edge(s) of the lid component that extend (at least somewhat) in the direction of the second lid component dimension ($L_2$). (Thus, it is thought that it will generally be the case that it is the open side face(s) of the space/cavity between the ground plane and the edge(s) of the lid component, which extend (at least somewhat) along the second lid component dimension ($L_2$), that resonate, and that these therefore form (a) virtual cavity resonator(s).)

It is also thought that, in most (if not all) embodiments, no (or at least very little) energy/radiation will be radiated/emitted from between the ground plane and edge(s) of lid component that extend (at least somewhat) in the direction of the first lid component dimension ($L_1$). (Thus, it is thought that the open end face(s) of the space/cavity between the ground plane and the edge(s) of the lid, which extend (at least somewhat) along the first lid component dimension ($L_1$), will generally function effectively as virtual ground planes for the virtual cavity(ies) that extend (at least somewhat) along the second lid component dimension ($L_2$), and that these virtual ground planes will therefore (it is thought) function as virtual waveguides.)

The communication device referred to above may be an RFID reader operable to be used in an application involving road vehicle detection and/or identification, and, of the parts and components of the RFID reader, at least the antenna's ground plane may be operable to be installed on the surface of the road.

The lid component may be substantially rectangular with dimensions $L_1 \times L_2$. Where this is the case, energy/radiation (RF EMR) radiated/emitted by the antenna may emanates (at least mostly) from between the ground plane and the long edges of the substantially rectangular lid component that extend (at least generally) in the direction of the second lid component dimension ($L_2$). (Thus, in these embodiments it is thought to be these two open side faces of the space/cavity, namely between the ground plane and the long edges of the lid, on either side of the lid, that resonate, and which therefore form virtual cavity resonators.)

Also, where the lid component is substantially rectangular with dimensions $L_1 \times L_2$, no (or at least very little) energy/radiation may be radiated/emitted from between the ground plane and the short edges of the substantially rectangular lid component that extend (at least generally) in the direction of the first lid component dimension ($L_1$). (Thus, it is thought that in these embodiments the two open end faces of the space/cavity, namely between the ground plane and the short edges of the lid, on either end of the lid, may function effectively as virtual ground planes and these may therefore (it is thought) function as virtual waveguides.)

The ground plane may extends substantially all the way across the (width of the) road, or all the way across (the width of) a lane of the road.

Referring to the form of the invention first described above under the heading Summary of the Invention, the size of the ground plane in the first ground plane dimension ($G_1$) is not necessarily the same as the size of the ground plane in the second ground plane dimension ($G_2$), but the size of the ground plane in both the first and the second ground plane dimensions ($G_1$ and $G_2$) may be at least five times greater than the wavelength of the antenna's operating signal (A). (i.e. $\{G_1, G_2\} \geq 5\lambda$)

In some particular embodiments, the road, or a lane of the road, may be approximately (or at least) 4 m wide and in the direction of the first ground plane dimension ($G_1$) the ground plane may be sized to (when installed) extend substantially all the way across this, and in the direction of the second ground plane dimension ($G_2$) the ground plane may extends for approximately (or at least) 1.5 m or more.

The planform shape of the lid component may be lesser in the first lid component dimension ($L_1$) than it is in the second lid component dimension ($L_2$) by a factor f, where $0.3 \leq f \leq 0.75$. (i.e. $L_1 = f\ L_2$ (or $L_{across} = f\ L_{along}$), where $0.3 \leq f \leq 0.75$—The length of the short side [$L_{across}$] may be selected to be below the cut off frequency of a wave guide of the desired signal frequency. The short side gap may therefore become virtually part of the ground plane and the cavity encapsulation.)

It will generally be the case that, at least in most embodiments of the invention, the second lid component dimension ($L_2$) is approximately half the antenna's operating signal wavelength ($\lambda$) plus or minus a matching factor (x) of up to 20%. (Thus, the antenna's lid component may have a length, in its longest dimension, that resonates at the antenna's operating signal frequency.) Therefore, by way of example, albeit without limitation, if the antenna's operating signal is about 800 MHz to 1 GHz in frequency, then in the direction of the second lid component dimension ($L_2$) the lid component may extend for between approximately 90 mm and 260 mm, and in the direction of the first lid component dimension ($L_1$) the lid component may extend for between approximately 27 mm and 195 mm. In a more specific (but again non-limiting) example, the antenna's operating signal may be about 920 MHz, and where this is the case in the direction of the first lid component dimension ($L_1$) the lid component may extend for approximately 75 mm, and in the direction of the second lid component dimension ($L_2$) the lid component may extend for approximately 180 mm.

It was mentioned above that the antenna is centre fed, and also that the lid component may be substantially rectangular with dimensions $L_1 \times L_2$. More specifically, the antenna may be fed at a location on the lid component that is half way between the sides of the lid component in the first lid component dimension ($L_1$) and halfway between the ends of the lid component in the second lid component dimension ($L_2$). (The antenna will typically be fed by a 50 ohm coaxial cable matched to the antenna impedance, as is conventional, although no strict limitation is to be implied in this regard.)

Referring to the plan form shape of the lid component, whilst this may be substantially rectangular with dimensions $L_1 \times L_2$ overall, the shape may also have one or more sides or edges that are meandered (i.e. made curved or wavy, to some extent at least, to thereby increase the length or distance traversed by the side or edge in between corners that are $L_1$ or $L_2$ apart). This edge meandering may have the effect of increasing the antenna bandwidth.

The lid component may be supported at a location spaced apart from (e.g. vertically above) the ground plane by one or more conductive support members. (In this regard, it is thought to be the height of the cavity and the length of the long side [$L_{along}$], or perhaps the height of the cavity and the length of the long side gap between the support members on the long sides, that determine the resonant frequency of the antenna. It is further thought that the selection of the ideal height for the cavity involves a balance or trade-off between the desirable but competing requirements for, on the one hand, a low antenna profile (which may be achieved, at least in part, by reducing the height of the cavity), and on the other hand, a small footprint for at least the lid component (which can be achieved, at least in part, by increasing the height of the cavity, but at the expense of low antenna profile/lid height).)

Where the lid component is rectangular, as discussed above, there may be four conductive support members, one located between each of the four corners of the rectangular lid component and the ground plane.

The distance that the lid component is spaced apart from (vertically above) the ground plane may be defined by the length (height) of the support member(s). It is thought that, in many embodiments, the distance (height) with which the support member(s) support the lid component apart from (above) the ground plane may be approximately the antenna's operating signal wavelength ($\lambda$) divided by a factor h, where $10 \leq h \leq 35$.

The distance between the support members in the second lid component dimension ($L_2$) (i.e. where the lid component is rectangular, this is the distance between the two support members that are at one of the short ends of the lid component and the other two support members that are at the other short end of the lid component) may be approximately half the antenna's operating signal wavelength ($\lambda$) minus approximately 1% to 10% (preferably minus approximately 5%). (It is thought that it may be the open side faces of the space/cavity, namely between the two support members, the ground plane and the long edge of the lid, on each side of the lid, that resonate, and therefore form virtual cavity resonators.)

The distance between the support members in the first lid component dimension ($L_1$) (i.e. where the lid component is rectangular, this is the distance between the two support members that are on one of the long sides of the lid component and the other two support members that are on the other long side of the lid component) may be approximately the same as the first lid component dimension ($L_1$) minus approximately 1% to 10% (preferably minus approximately 5%).

The ground plane may include (or incorporate) a base plate (the base plate may be initially formed separately from other parts of the ground plane, but when the antenna is fully assembled and installed (e.g. on the road) the base plate should be incorporated into, and it should form an integral part of, the ground plane), and the lid component may be spaced apart from but also (at least approx) parallel to the base plate, such that the space (the "cavity") between the lid component and the ground plane is the space between the lid component and the base plate. Both of the lid component and the base plate may be formed from a substantially rigid and conductive material. This will typically be metal, but other substantially rigid and sufficiently conductive materials, such as e.g. carbon, may also be used. The material used to form the lid component and the base plate also need not necessarily be the same material.)

The base plate may be substantially planar and with a plan form shape that is larger than that of the lid component but smaller than that of the ground plane (of which the base plate actually forms an integral part).

The lid component may be supported at its location spaced apart from (vertically above) the base plate by the one or more support members referred to above.

A filler or supporting material may be provided in the space between the ground plane and the lid component. This filler or supporting material may be used to provide additional structural reinforcing or support between the ground plane and the lid component. However, the presence of this filler or supporting material is not necessarily critical, and where the antenna is likely to be exposed to no loads (or only light loading), it may be omitted. Nevertheless, where the filler or supporting material is present (to better enable the antenna to better endure significant, repeated loads, for example), this may give the overall antenna structure a configuration that might be described as resembling "wafer", i.e. like a biscuit with a comparatively softer filling (the support material) in between two more rigid layers (the base plate/ground plane and the lid component). Furthermore, as has been explained above, the width of the antenna (and specifically the lid component) in the first lid component to mention $L_1$ is less (preferably much less) than the length of the antenna (and the lid component) in the second lid component dimension $L_2$. The lid component is also smaller (preferably much smaller) than the ground plane. Thus, the antenna's overall configuration may be described as asymmetric, even "massively asymmetric". For this reason, the applicants at least refer to this particular antenna design is a "Massively Asymmetrical Wafer Antenna" or "MAWA". Furthermore, for reasons that have been explained, this Massively Asymmetrical Wafer Antenna can be thought of as being, in effect, or at least functionally/notionally similar to, a combination of an adapted wave guide antenna and an adapted cavity antenna.)

The filler or supporting material may substantially fill the space (cavity) between the ground plane and the lid component in between the support members.

The filler or supporting material may be a compression resistant material, and it may also (and preferably does) have a low dielectric constant and/or substantially constant dielectric properties, at least at the antenna's operating signal frequency.

The antenna structure may further include a protective cover. The protective cover may be in contact with the ground plane and it may extend over the lid component in order to protect (at least) the lid component. The protective cover may be in contact with the ground plane all the way around lid component, and the lid component and the space between the ground plane and the lid component may be enclosed within the ground plane and the protective cover.

The protective cover may function (at least in part) as a radome. Alternatively, or in addition to this, the protective cover may also be operable to (assist the ground plane to) lower the antenna's radiation pattern (i.e. reducing the elevation angle of the path of maximum gain and directing the bulk of the radiation to the area between the path of max gain and the ground plane).

The protective cover may have one or more edges, which extend from the ground plane to the level (or above the level) of the lid component, and the one or more edges may have at least a portion which is sloping (upwards and inwards) to assist in reducing impact or shock to a vehicle tire or the like that contacts or rolls over the protective cover (or a portion of it). (The thickness and shape of the sides of the cover may also be at least part of what helps to concentrate the antenna's radiation below the path of max gain.)

One or more of the edges of the protective cover may be straight (i.e. not curved or meandering) along their length (i.e. along the sides and ends where the overall plan form shape of the protective cover is rectangular).

In another form, the present invention relates broadly to an RFID reader incorporating or operable to be used with an antenna described above.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows:

In FIGS. 12 and 13, the base plate (which is part of the ground plane) is shown, but other parts of the ground plane that surround the base plate are not shown. The ground plane, which includes/incorporates the base plate visible in these Figures, sits directly on the road (not shown).

FIG. 13—exploded perspective view of the RFID reader structure (or the portion thereof including the reader antenna structure) in accordance the same embodiment FIG. 14—side-on view of the RFID reader (antenna) structure, which sits on and above the road surface, in accordance with the same embodiment, but also showing (by way of non-limiting example) other electronics that could possibly be associated with the RFID reader and which may be (at least in this particular installation, although they need not always be) located in the road (i.e. buried beneath the road surface and beneath the antenna etc).

FIG. 18—(i)a and (i)b are graphical representations of the shape of the radiation pattern produced by an antenna (a wafer antenna) in accordance with another possible embodiment of the invention, and (ii) and (iii) are graphical representations of the shape of the radiation pattern produced by the same (wafer) antenna compared to the shape of the radiation pattern produced by an alternative type of (mushroom) antenna, being an antenna of the type described in patent application '994

DETAILED DESCRIPTION

FIG. 11, FIG. 12, FIG. 13 and FIG. 14 all illustrate an RFID reader structure, or at least they all illustrate the portion of it that includes the RFID reader antenna, in accordance with one possible embodiment of the invention. As shown in these Figures, the RFD reader structure (or the portion of it that contains the antenna) includes a base plate 61 (which is itself part of the antenna's ground plane—see below), a protective cover 62 (which in this case takes the form of a transparent, generally flat, rectangular "dome" made of a strong/structural (and preferably transparent or translucent) material such as polycarbonate, an engineering plastic like acetal (also known variously by such names as Delrin, Celcon, Ramtal, and others) or the like), four corner support members or "pillars" 63, a lid component (hereafter simply the "lid") 64, a block 66 of support or filler material (the "support block" 66), and a feeding conductor/pin 67. These various parts and components of the RFID reader antenna structure will be discussed in greater detail below.

Figure 7:
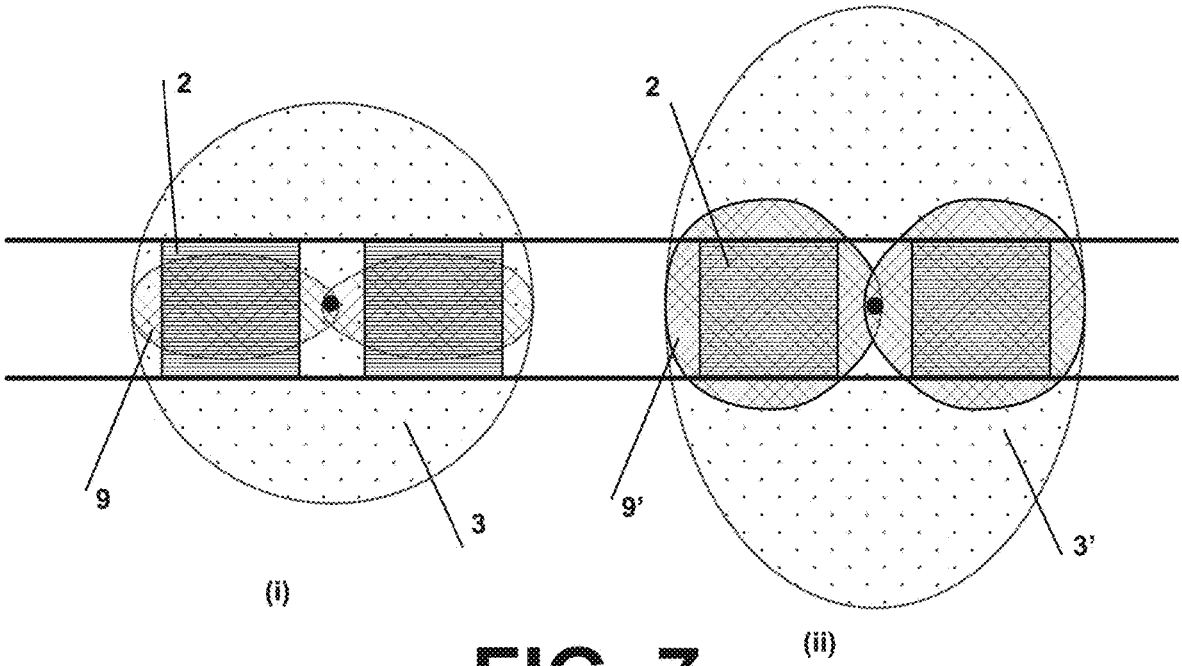
FIG. 7—(i) schematic representation of the potential reduction in the width of the effective read zone 9 as a consequence of increased directionality of on-plate RFID tag antenna radiation (e.g. due to vehicles which have large, bluff fronts); and (ii) a possibly preferred RFID reader antenna radiation pattern shape (or at least a preferred shape when viewed in plan form) 3' which may help to accommodate for this.
Figure 8:
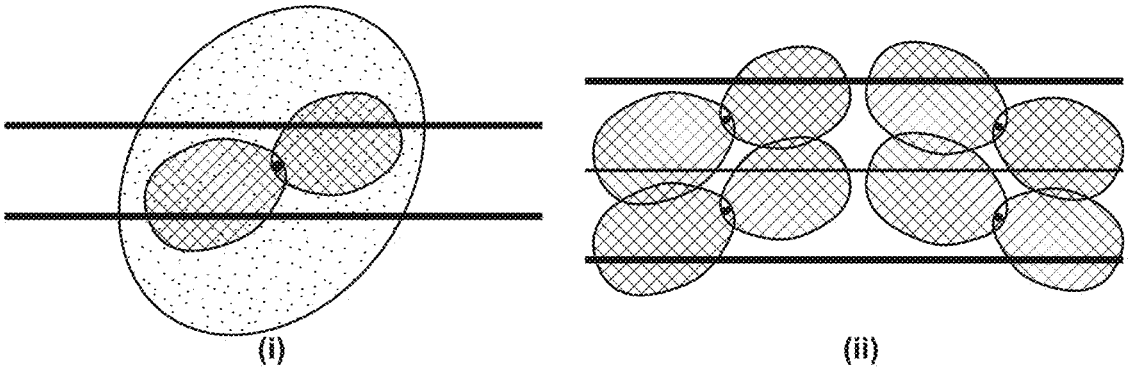
FIG. 8—(i) schematic representation of a possible alternative approach for addressing the potential reduction in the width of the effective read zone, as depicted in FIG. 7(*i*), where the radiation pattern shape is made to switch between pointing diagonally left and diagonally right using time division multiplexing; and (ii) schematic representation of the need for the multiplexing to be synchronised as between nearby antennas FIG. 9—perspective view of a typical conventional retroreflective ("cat eye") road marker.

This particular embodiment of the invention will be described with reference to, and in the context of, its use in road applications where the RFID reader antenna communicates with RFID tags which are located on (or integrated as part of) vehicle license plates. This embodiment of the invention will also be explained below with reference to a situation in which the RFID reader antenna is installed on the road (and commissioned and used) in a manner that causes the reader antenna's radiation pattern to extend more across the road (i.e. more in a direction perpendicular to the direction of vehicle travel on the road) than it does along the road, as shown in FIG. 7(*ii*). However, it is to be clearly understood that this and other embodiments or variants of the invention may also be capable of installation on the road (and commissioning and use) in a manner that causes (or enables) the long dimension of the reader antenna's radiation pattern to extend at least somewhat more along the road than simply directly across, and possibly with the additional ability to rapidly switch (i.e. between diagonally-left and diagonally-right) using multiplexing, as discussed above with reference to FIG. 8. This last, however, will not be described in detail.

Referring to the base plate 61, as mentioned above, this is (or it becomes, when the antenna is fully assembled and installed) an integral part of the antenna's overall ground plane. The ground plane is conductive overall (at least at the antenna's operating frequency), and so the base plate 61, which is part of the ground plane, is also made from a conductive material. Typically, the base plate 61 will be made from a substantially rigid, conductive material, e.g. such as aluminium (or some other substantially rigid, conductive metal), although other materials (e.g. such a carbon) might also be used. Because the base plate 61 is made from a material which is substantially rigid in addition to being conductive, the base plate 61 therefore provides a structural base upon which other components of the antenna structure can be mounted, including the pillars 63, the lid 64, the support block 66 which is between the base plate 61 and the lid 64, and the protective cover 62.

The way in which the base plate 61 is integrated (or made to be an integral part of the overall larger ground plane) is not narrowly critical and any means for achieving this may be used. Typically, the fact that the base plate 61 is made from a conductive material, and that other surrounding portions of the overall ground plane, which are in contact with at least the edges of the base plate 61, are also conductive (at least at the antenna's operating frequency) may suffice to ensure that the overall ground plane, including the base plate 61 and the other portions of the ground plane that surround it, is conductive. In any case, it is to be emphasised again (and clearly understood) that the base plate 61 depicted in FIG. 11, FIG. 12, FIG. 13 and FIG. 14 is not itself the ground plane (or not the whole of the ground plane—the whole of the ground plane is illustrated in FIG. 15). Rather, the base plate 61 is a conductive component that becomes an integral part of the larger, overall ground plane when the antenna is assembled and installed, and the base plate 61 forms a rigid structural component upon which other components of the antenna structure may be mounted. Further explanations relating to particular features and functions of the base plate 61 will be given below.

The antenna's overall ground plane, including the base plate 61 and the portions of the ground plane that surround it, should be applied to (or installed directly onto) the surface of the road. The actual size of the ground plane (in terms of its length and width on the road, and also its overall shape) will be discussed below, but it should be noted again that in FIG. 11, FIG. 12, FIG. 13 and FIG. 14 it is only the base plate 61 that is shown, not the whole ground plane. The whole ground plane is shown in FIG. 15.

In general terms, the ground plane overall (and in particular the portions of it that surround the base plate 61) forms a fairly thin layer which is typically applied immediately onto or on top of the road surface (the thickness of the ground plane is not necessarily critical to the invention, and it may vary from embodiment to embodiment or depending on how the ground plane is made, but by way of indication (albeit without limitation) the thickness of the ground plane may vary from several millimetres up to a few centimetres). Typically, the portions of the ground plane that surround the base plate 61 will be formed as discussed below, and the base plate 61 will then be installed somewhere within the boundaries of this. Typically the base plate 61 will be installed at the geometric centre of the ground plane; however this is not necessarily critical, and it may often be sufficient for the base plate 61 to be located somewhere towards the centre or middle of the ground plane, if not in the exact geometric centre. But the base plate 61 generally should not be right near the perimeter edge of the overall ground plane, otherwise other parts of the antenna may not be adequately shielded by the ground plane—see below.

In this embodiment, rest of the antenna structure sits (or is mounted) directly onto the upper side/surface of the base plate 61 once the base plate is installed on the road, or possibly even before the base plate is installed on the road or relative to the other portions of the ground plane. In this particular embodiment (see FIG. 13 in particular) a somewhat thinner or recessed portion 65 is provided in the middle on the upper surface of the base plate 61. The short vertical wall that extends around and defines the recess 65 in the base plate 61 is actually the same shape as the outer perimeter of the base of the protective cover 62. Therefore, when the protective cover 62 is installed onto the base plate 61 (with the other components contained beneath the cover 62 and between the cover 62 and the base plate 61) the outer perimeter edge of the recess 61 provides outer support for the perimeter base portion of the cover 62. This may help to reinforce the base portion of the cover 62 and prevent it from deforming or flexing outward, e.g. in the event that a car or vehicle drives over the antenna thereby imposing a downward force that might otherwise tend to squash the cover 62 and make it deform outwards. Reinforcing the base of the cover 62 and helping to prevent it from deforming/flexing outwards in this way also helps to reinforce the overall cover 62 (including the upper portions thereof) in the vertical direction. This is because preventing the base of the cover 62 from deforming/flexing outwards also thereby helps to prevent the upper portions of the cover 62 from being forced to move downwards, toward the surface of the road. In other words, it helps to prevent the overall cover 62 from "flattening out", and this in turn may help to provide additional protection for the components house between the cover 62 and the base plate, such as the lid 64 and the pillars 63.

As has been mentioned, the overall ground plane should be conductive. For the avoidance of doubt, unless the context clearly dictates otherwise, reference herein to the ground plane being "conductive", or to the word "conductive" generally, should be understood as meaning (or including) fully conductive but also partially conductive but effectively fully conductive at the antenna's operating frequency (typically around 1 Ghz, although other operating frequencies are also possible) even if not necessarily so other frequencies.

The ground plane overall must generally be of a certain size, or at least a certain minimum size. One important reason why the ground plane should generally be of a certain size is to help ensure that it (i.e. the ground plane) operates to adequately shield other parts (particularly conductive and radiating parts) of the antenna structure from the potentially widely and dynamically variable radio frequency influences of the underlying road, other "near ground" effects, etc. Another reason why the ground plane should generally be of a certain size is to help ensure that it operates to adequately shield any electrical cables, electronics, etc, that may be located beneath the ground plane from the potentially very strong magnetic fields that are created by electric vehicles which are becoming increasingly common on public roads.

The overall ground plane can actually have any shape, provided its size (in all directions along the ground) is sufficient to provide adequate shielding for other portions of the antenna. And as mentioned above, the other conductive and radiating components of the antenna should be located sufficiently towards the middle of the ground plane, and away from the perimeter edge of the ground plane, to be adequately shielded.

In the particular embodiment described herein, and e.g. shown in FIG. 15, the overall ground plane has a planform shape (i.e. a shape which when viewed in orthographic projection) which is greater in a first ground plane dimension ($G_1$) than it is in a second ground plane dimension ($G_2$) perpendicular to the first ground plane dimension ($G_1$) (i.e. $G_1 \perp G_2$ and $G_1 > G_2$). However, as has been mentioned, the ground plane could potentially be shaped in other ways.

The ground plane should preferably be installed on the road surface (as discussed above) and with, in this particular example, the second ground plane dimension ($G_2$) oriented parallel to the direction of vehicle travel on the road (i.e. $G_2=G_{along}$).

In the particular embodiment presently described, the ground plane is essentially planar (i.e. a thin layer on the road) and rectangular in plan form shape with dimensions $G_1$ (or $G_{across}$)×$G_2$ (or $G_{along}$), where $G_1$ (or $G_{across}$)>$G_2$ (or $G_{along}$) as mentioned above. More specifically, in a particularly preferred version of the present embodiment, and where the other parts of the reader and antenna structure have the particular dimensions discussed below, the ground plane should be a generally thin, planar rectangle with dimensions of $G_1$=4 m (or thereabouts) and $G_2$=3 m (or thereabouts). Note that, in relation to the first ground plane dimension $G_1$ (or $G_{across}$)=4 m (approx), this corresponds to the full width of the single lane on most roads. For roads that have lanes even wider than this, it may be that the size of the first ground plane dimension $G_1$ (or $G_{across}$) is even greater than 4 m, so as to extend all the way across the road lane (although this also may not always be necessary). It is to be clearly understood, however, that in other embodiments, and particularly if the other parts of the reader and/or antenna structure have sizes or dimensions different to those of this particular embodiment (which may occur e.g. if the antenna is to operate with a different signal frequency), or perhaps in other operational examples, the absolute and relative dimensions of the ground plane may also change compared with that just described.

Without limitation to what has been said about this elsewhere, in order for the ground plane to adequately shield other parts of the antenna structure from the potentially variable radio frequency influences of the underlying road (and from other "near ground" influences), the ground plane (and hence the material or substance from which it is formed) may (at least when "finished" and ready for use) need to have a minimum conductivity. Or in other words, the ground plane may (when finished/installed and ready for use) need to have resistivity which is below a certain maximum. For the particular antenna structure(s) proposed herein, and given the antenna power, desired radiation pattern shape, antenna gain, antenna return loss, etc, the ground plane (and hence the material/substance from which it is formed) should, it is thought, preferably (when installed, finished and ready for use) have a conductivity of approximately $10^3$ S/m or more (i.e. the conductivity should preferably be approx. equal to or more than 1000 Siemens per meter). To put this another way, the conductive ground plane (and hence the material/substance from which it is formed) should, it is thought, preferably (when finished) have a resistivity below approximately $10^{-3}$ Ωm (i.e. the resistivity should preferably be equal to or less than 0.001 ohm meters).

In relation to the creation/formation/installation/deployment of the conductive ground plane, and in particular those portions of it other than the base plate 61, this should preferably be as economical and non-disruptive as possible, both in terms of the time, cost, complexity, etc, involved in the creation/formation/installation of the ground plane itself, and also given that it will usually be necessary to close the road (or at least a section of the road or the lane(s) involved) while this is taking place.

It was mentioned above that the ground plane may need to have a minimum conductivity (or in other words a resistivity which is below a certain maximum), and it was also mentioned that for the particular antenna structures proposed herein, given the antenna power, desired radiation pattern shape, etc, the conductivity should preferably be approximately $10^3$ S/m or more. If the conductivity of the ground plane is greater than approximately $10^6$ S/m, this may in fact be considered to be "fully" conductive, and this may actually be suitable or even ideal for providing shielding in the present antenna application; however this is certainly not a requirement and embodiments of the invention may still operate very effectively with ground planes where the conductivity is considerably less than "fully" conductive.

A conductive ground plane for which the conductivity is greater than approximately $10^6$ S/m could be created if it (or the portions of it other than the base plate 61) were to be made from a mesh made solely or mainly of, for example, stainless steel, copper, aluminium or certain other suitably conductive metal alloys, or perhaps from steel wool or metal cloth. However, the practicalities and difficulties associated with applying such a metal mesh to the road surface (at least or especially if the mesh is a separate, stand-alone object and not embedded in or as part of some other object or substance that can be more easily applied to the road) mean that creating portions of the ground plane that surround the base plate 61 from nothing (or little) more than such a metal alloy mesh may perhaps be less attractive than other possible alternatives (some of which are discussed below). Also, a ground plane which (around the base plate) is made from nothing (or little) more than a metal mesh may also have certain associated risks/hazards, particularly e.g. if the mesh were to lift off the road surface due to improper or imperfect installation, or as a result of wear and tear, etc. Therefore, whilst the use of a ground plane made (apart from the base plate) from nothing (or little) more than a metal alloy mesh could be highly effective in terms of its ability to shield the antenna structure from the potentially variable radio frequency influences of the underlying road (and from other "near ground" influences), and whilst embodiments of the invention could well operate with a ground plane (apart from the base plate) made from such a simple metal alloy mesh, nevertheless for practical reasons it is thought that this is less likely to be used (or perhaps it will be used less often) than other possible alternative means for forming the ground plane (apart from the base plate).

As an alternative, the ground plane (apart from the base plate) could instead be formed and applied as, for example, a paint (or as a fluid which is applied to the road in a similar manner to paint), or as an epoxy which is applied to the road, or even as a polymer which can be melted onto the surface of the road. To achieve the required minimum level of conductivity (see above), a conductor or some form of conductive component or substance could be blended or otherwise incorporated into any of these, in an appropriate quantity (in the case of conductive substances), prior to installation.

Another consideration that may affect the means chosen for forming the ground plane (apart from the base plate) is that the surfaces of roads generally expand and contract and change shape somewhat with time. For instance, when a road is loaded as a vehicle wheel presses down thereon as it passes, the road surface will momentarily compress/change shape slightly beneath and due to the pressure imposed by the vehicle wheel. Also, expansion and contraction of the road surface can occur due to temperature fluctuations (e.g. between day and night, or with the change of season, etc). This expanding and contracting and changing of shape, often repeatedly/cyclically, can consequently create cyclic loading/stress and hence fatigue in any structure which is connected or bonded thereto. This may in turn to lead to fatigue-related failure, for example, of any ground plane (or ground plane layer) which is provided thereon, especially if the ground plane (or ground plane layer, apart from the base plate) is in the form of a rigid or brittle structure. On the other hand, the ground plane (or ground plane layer, apart from the base plate) will generally be much less susceptible to fatigue if it is formed from a substance which has, or if its structure allows or provides (at least a degree of) resilience, flexibility, "give" or the like.

With the foregoing in mind, one means for providing the ground plane (apart from the base plate) which, it is thought, could be suitable (including because it can provide the required conductivity but also because it may potentially be produced economically, applied to the road with minimum disruption, and provide a degree of resilience once formed) is to use a substance which can be applied as a paint, or as an epoxy infused cloth that can be laid onto the road, or as a polymer that can be melted onto the road, and whichever of these is used, a conductive component/substance possibly in the form of e.g. graphite powder (or perhaps particulate aluminium or other metal, or the like) may be incorporated or blended into the paint, epoxy or polymer. Other conductive components/substances (i.e. other than graphite powder) may of course also be used. Nevertheless, referring for instance to a ground plane (or ground plane layer, apart from the base plate) which is formed from an epoxy/graphite blend, as a comparative example of the hardiness of a ground plane/layer formed in this way, epoxy/graphite blends are often also used in yacht building for load-bearing structures and surfaces. Also, epoxy/graphite blends can have a conductivity of up to approximately $10^4$ S/m (which it will be noted is easily sufficient for the purposes of the present invention).

Another means which is thought to be possibly suitable for forming the ground plane (apart from the base plate) is to use carbon cloth (which can have a conductivity in excess of $10^5$ S/m) which is painted or epoxied onto the road surface. Such a carbon cloth may alternatively be embedded in polymer sheets which can themselves be melted onto the road surface. In other applications and industries, such as boat and yacht building and repairs etc, it has been shown that maintenance and repair of carbon cloth layers/surfaces/structures, and similarly maintenance and repair of carbon cloth infused epoxy/polymer layers/surfaces/structures, can be relatively easy, cost and time efficient, and effective, using well-understood processes and techniques (none of which require detailed explanation here).

The component, substance or element within the ground plane (apart from the base plate), which provides the conductivity, should preferably be close (ideally as near as possible) to the upper surface of the ground plane when the ground plane (or layer) is applied/formed/installed on the road. In other words, once the ground plane (apart from the base plate) has been applied/formed/installed on the road, within the vertical thickness of the structure/layer of the ground plane, the component, substance or element which provides the conductivity should preferably be as near to the top as possible. This is because the nearer the component, substance or element which provides the conductivity is to the upper surface, the better the shielding it will provide to the other parts of the antenna structure. Of course, this may also often need to be balanced against the need for the component, substance or element which provides the conductivity to be covered so as to protect it from exposure to the elements, damage or wear when vehicles drive over it, etc.

Yet another means which is thought to be possibly suitable for forming the ground plane (apart from the base plate) is to use a form of prefabricated "patch" type product which can be applied to the road. These could be similar to in many ways to, for example, the road repair/modification product produced by South African company A J Broom Road Products (Pty) Ltd and referred to by them as the BRP Road Patch. Hence, the ground plane (apart from the base plate) could possibly be created using something similar to the BRP Road Patch; that is to say, the ground plane (apart from the base plate) could possibly be created using a prefabricated product that is manufactured on paper (or some other suitable substrate or base material) and onto which a bitumen rubber binder (or some other similar binder) holds bitumen pre-coated aggregate. The prefabricated product thus produced could be supplied in thin sheets (i.e. prefabricated sheets) which are dimensioned to suit the intended application (see above in relation to the size of the ground plane). The base plate 61 could potentially be installed before, after, or at the same time as, the patch is installed on the road to form other portions of the ground plane.

Still referring to the possibility of forming the ground plane (apart from the base plate) using a prefabricated patch like product, as described above, the particulate/grain/pebble size of the aggregate bound in the bitumen rubber binder may also be selected to suit; for example, in order to be similar to or match the particulate/grain/pebble size of the aggregate in the road onto which the patch is to be applied. The overall colour of a said patch (including, or due to, the colour of the aggregate) may be made (or the aggregate may be blended) to generally match the colour of the road onto which the patch is to be applied, such that the patch appears to simply be a part of the road (i.e. it is indistinguishable from the road) when applied. Alternatively, the patch could be coloured, or it could have markings (e.g. border or edge markings), etc, in order to make the patch clearly visible or easy to visibly differentiate from other parts/areas of the road. This latter may be of use in situations where it is preferable, or especially where there is a requirement, for vehicle operators/drivers to be able to see (and hence so that they can know) when they are about to pass over an area/location containing an antenna that will detect and/or identify their vehicle—this can be important for privacy reasons, and/or for compliance with requirements for transparency in systems used in law enforcement and evidence collection for providing evidence which has been collected in a lawful and non-questionable fashion, etc. The aggregate, and the "particles" that make it up, may also include an appropriate quantity or proportion of particles that are lighter coloured, or reflective, or perhaps which are reflective particularly for light in particular spectral ranges such as the infrared spectrum. These lighter and/or reflective particles are not necessarily intended simply to lighten the overall colour of the patch surface (they may also have this affect to some extent, although they also may not, depending on the way in which and the proportion in which they are incorporated in the aggregate)—rather part of the purpose of including an appropriate quantity or proportion of particles that are lighter coloured, or reflective, or reflective of radiation in certain parts of the spectrum (e.g. infrared in particular) is to help reduce heating and heat retention, and perhaps provide some degree of radiant heat reflection. Reducing heating and heat retention in the ground plane (and in the road material beneath it) may often be important for preventing possible heating or overheating of electronics associated and located with the antenna, given that the antenna sits directly on top of the ground plane and the road material beneath it.

A prefabricated patch like that described above may be adhered to the road surface to form the ground plane (apart from the base plate) in any suitable way or using any suitable technique. By way of example, such patches may be adhered using cationic emulsion or anionic emulsions.

In order for a prefabricated patch like that described above to have sufficient conductivity, a conductor or some form of conductive component or substance could be included in the mixture (along with the aggregate, etc) bound within the bitumen rubber binder. Alternatively, an aluminium alloy or other metal conducting mesh could be incorporated into (or as part of the patch) such that the said conductive metal mesh (rather than simply being applied to the road as a standalone mesh) is applied to the road as part of (or within) the patch product. As a further alternative, particulate or granular aluminium (or other metal) could actually be included in (i.e. as part of) the aggregate which is coated in bitumen in the initial formation/fabrication of the patch. The patch thus produced would then potentially have the necessary conductivity, by virtue of the aluminium (or other metal) contained in and as part of the aggregate. This may also have the benefit of providing a useful option for the recycling of waste aluminium (or other metal) from other sources.

As well as providing shielding, the conductive ground plane may also assist with one or more of the following: concentrating the radiation emitted by the antenna into the desired azimuth zone (which is preferably in the shape of an ellipse or other shape is discussed below); reducing the angle of elevation of the path of maximum gain in the colon and concentrating the radiation pattern below the path of maximum gain.

Figure 1:
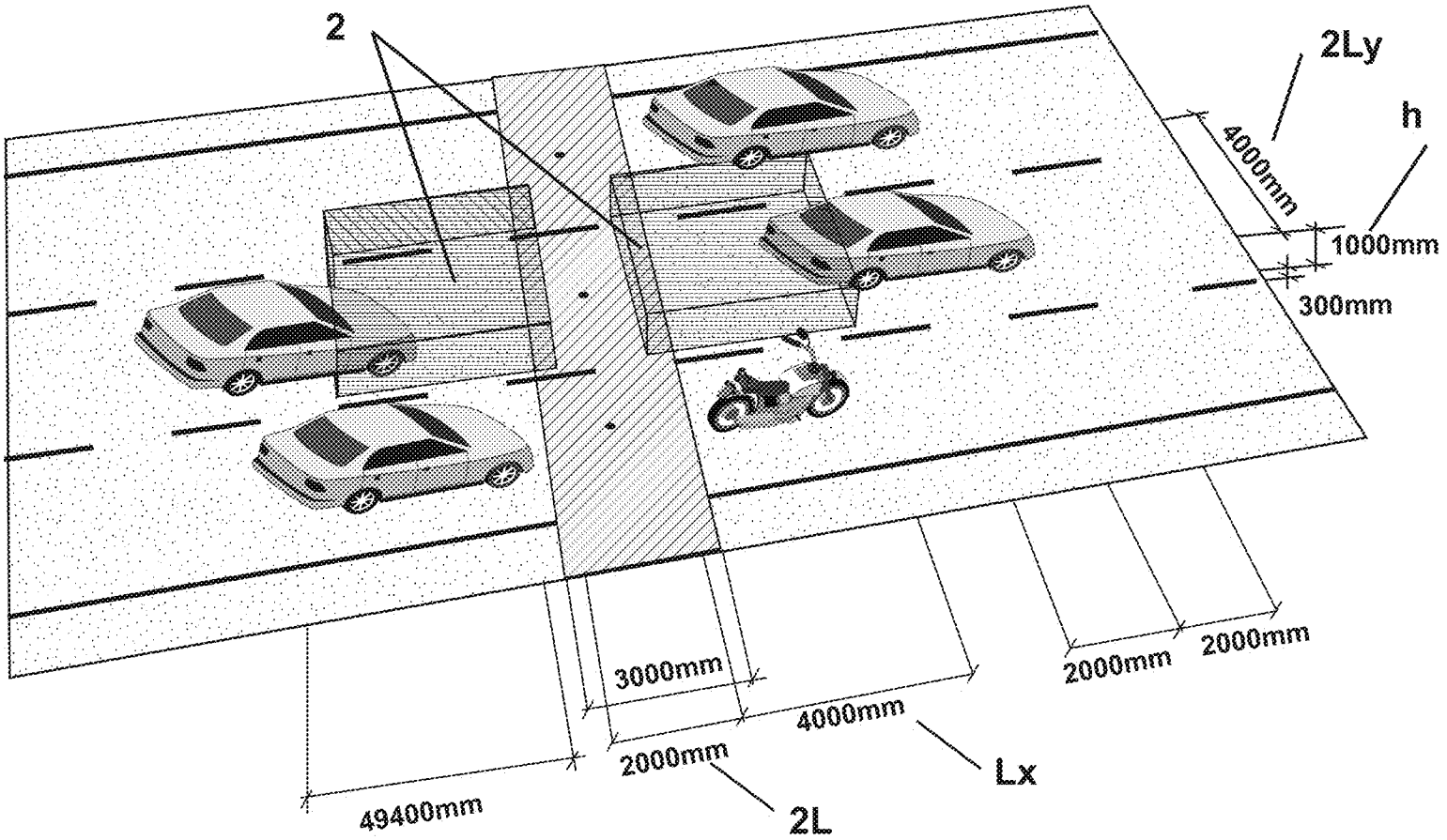
FIG. 1—schematic representation of the required read-zone for an on road RFID reader antenna.
Figure 2:
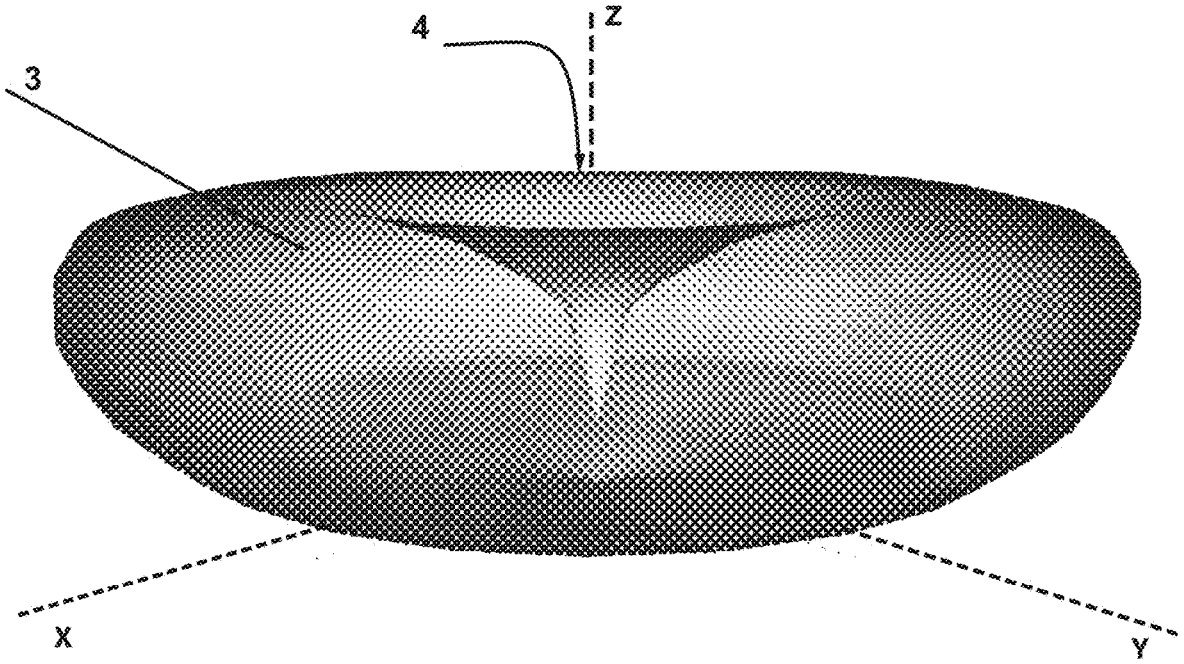
FIG. 2—"dropped doughnut" (or "squashed toroid") shaped antenna radiation pattern, which is omnidirectional in the azimuth plane, and which has previously been considered desirable for an on road RFID reader antenna.
Figure 3:
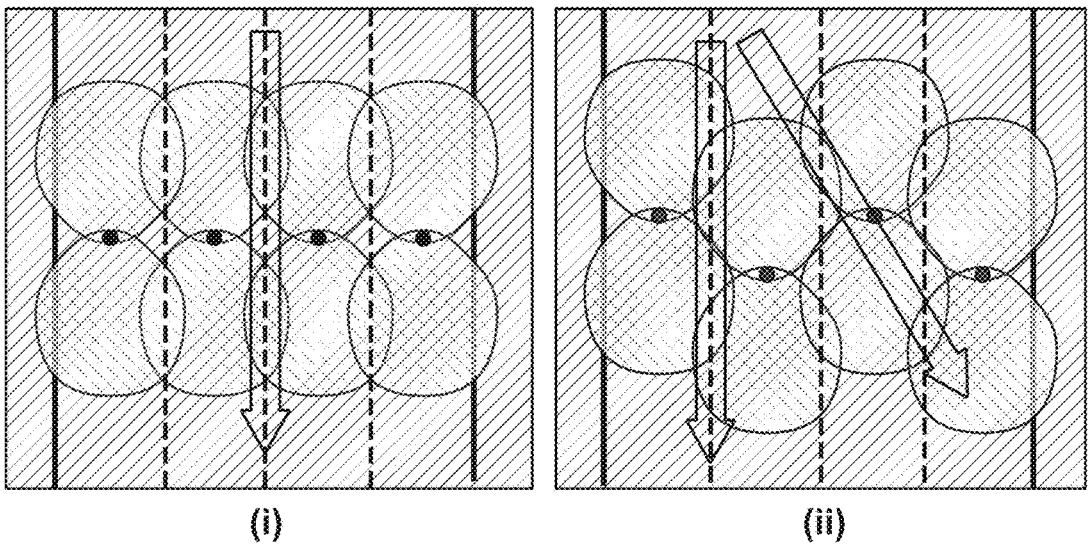
FIG. 3—schematic illustration for the way that "cross-talk" may arise for a vehicle's RFID tag where multiple RFID reader antennas each of which provides an omnidirectional radiation pattern are used.
Figure 4:
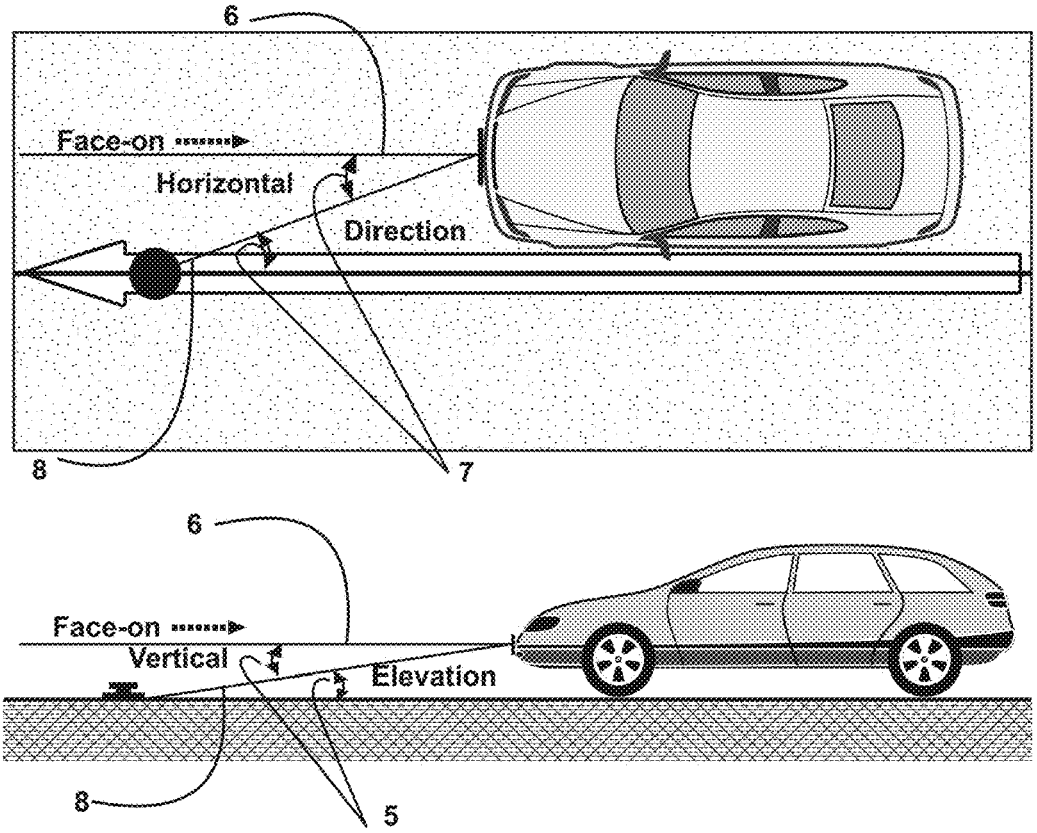
FIG. 4—elevation/height and directional/horizontal offsets of the radiation communication path between a vehicle license plate's RFID tag and an on road RFID reader antenna, relative to the plate's "face-on" direction.
Figure 5:
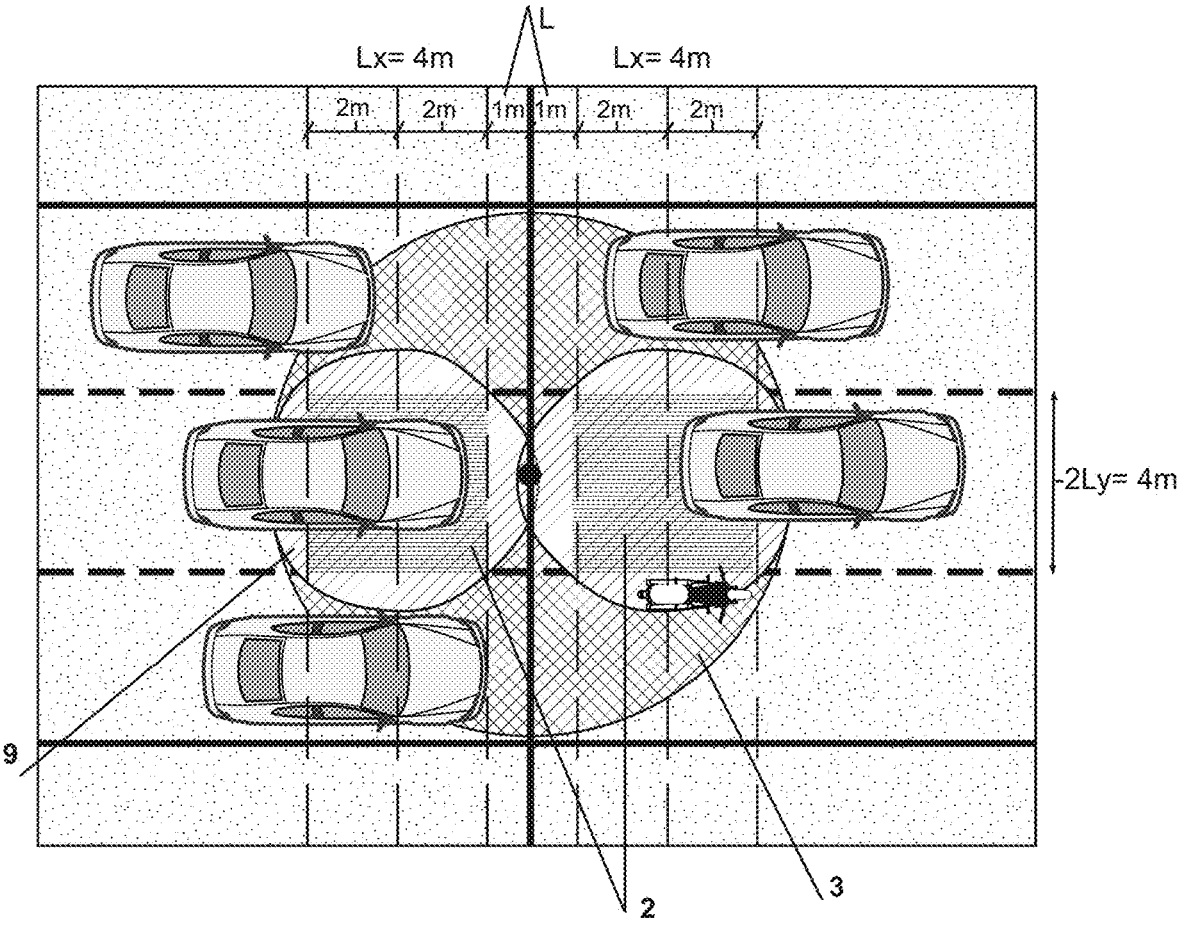
FIG. 5—plan (or planform) view of a three lane road with an RFID reader antenna placed on the road in the middle of the centre lane. Note: the fact that this Figure illustrates only a single RFID reader antenna, located in the centre lane, is for clarity of illustration only. Normally, in practice, there will be an RFID reader antenna placed in the middle of each lane—see FIG. 1. Note also: reference numeral 3 in this Figure represents the radiation pattern of the RFID reader antenna, where that radiation pattern is omnidirectional (i.e. equally in all radial directions) in the azimuth plane, as has previously been considered desirable.
Figure 6:
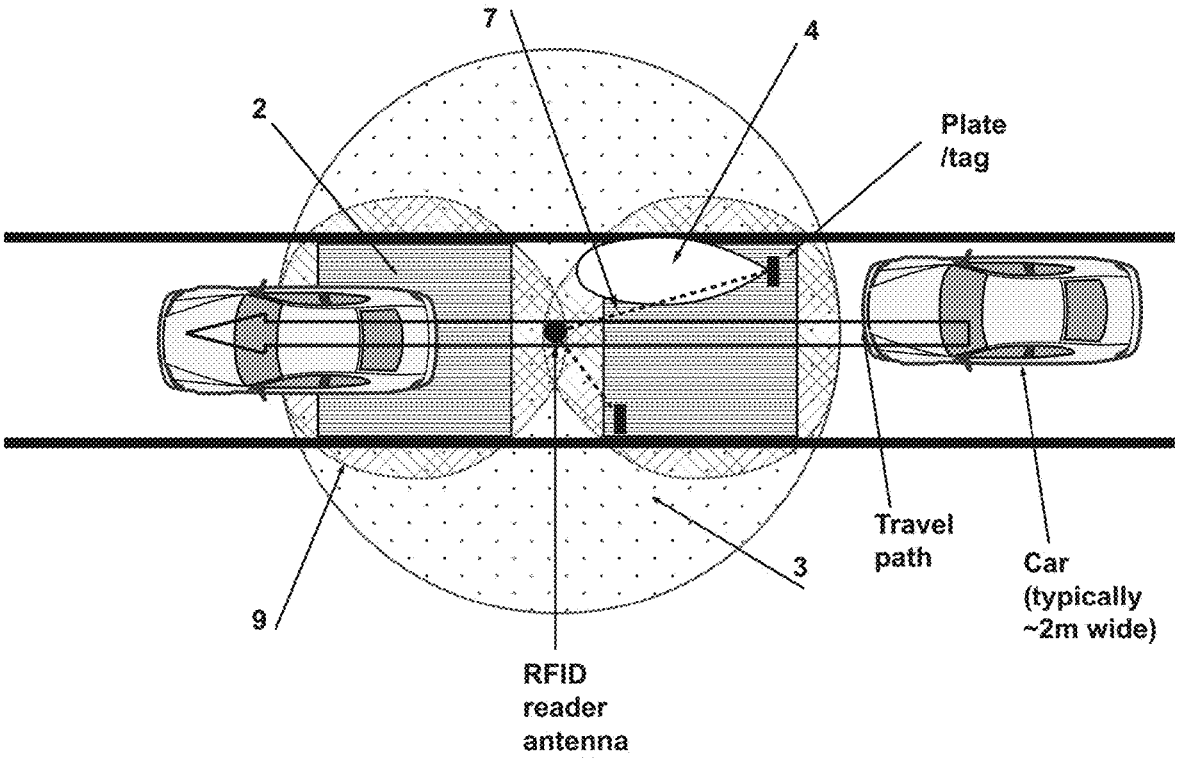
FIG. 6—plan view (i.e. when viewed in planform) of a single road lane with an RFID reader antenna placed on the road in the middle of the lane. Note: reference numeral 3 in this Figure again represents the radiation pattern of the RFID reader antenna, where that radiation pattern is omnidirectional (i.e. equally in all radial directions) in the azimuth plane, as has previously been considered desirable.

The overall ground plane of the RFID reader antenna structure (which is part of an RFID reader structure) has been explained above. It has also been explained that parts of the reader antenna (and of the reader) other than the ground plane sit or are mounted on top of the ground plane, and in particular on top of the base plate 61. It has further been explained that the conductive ground plane may need to have a certain minimum size, for instance in order to adequately shield the antenna structure. In situations where only a single antenna (corresponding to a single RFID reader) is used (e.g. installed in the road) at a given location, the antenna structure will have its own associated ground plane. However, there may be situations where multiple RFID reader antennas are used at a given location. To help visualise this, consider FIG. 5. FIG. 5 actually shows a situation where only a single RFID reader antenna is used at the depicted location—on the surface of the road in the middle of the centre lane. However, in other situations, it could be that multiple antennas are used, e.g. in a line across the road. For instance, there could be situations in which there is an antenna mounted in the centre of each lane of the road, such that the antennas together define a line across the road. In such situations, the multiple antenna structures need not necessarily each have their own unique ground plane separate from the ground plane of any of the other antennas. Instead, a single conductive area could potentially (possibly) be provided and shared by some or all of the antennas, such that the single area operates as the ground plane for two or more separate antennas. As one possibility, a single partially conductive area shared by all of the antenna structures (where the multiple antenna structures form a line across the road) could be provided as a wide strip (3 m or more wide) extending across all lanes (i.e. across the total width) of the road. This is depicted in FIG. 1.

It should be noted though that, in situations where multiple antennas are used at a given location (e.g. as just discussed), each one (or one or more of them) could still have its own associated (i.e. unique and un-shared) ground plane separate from the ground plane of any of the other antennas. This could possibly occur, say, if the reader antenna in one lane were to be located somewhat further down the road than a reader antenna in an adjacent lane, such that a simple partially conductive strip extending perpendicularly across the road (i.e. like shown in FIG. 1) would not provide adequate coverage around each antenna. However, from a practical point of view, the time, cost, effort, etc, associated with installing or creating a separate ground plane for each antenna structure may be greater than for installing or creating a single larger partially conductive area (e.g. like the wide strip extending across the road mentioned above) which is shared by some or all of the antennas and operates as the ground plane for those antennas, so providing a common/shared ground plane for multiple reader antennas may be desirable where possible. Another possible benefit is that such a strip could be coloured, or it could have markings (e.g. edge markings extending across the road before and after the antenna structures in the vehicles' direction of travel), or it could have a different surface texture or stone/particle size or the like, etc, in order to make the strip clearly visible (or perhaps audible when driven over), which (like above) may be of use where vehicle operators need to be able to see when they are about to pass over an area/location where their vehicle will be detected and/or identified (or at least know or be alerted when this happens). Also, like above, the strip may incorporate lighter coloured or reflective particles to assist in minimising heating and heat retention, etc.

Returning again to consider the RFID reader antenna structure generally, as has been explained, this also includes a lid component (lid) 64. The lid has a planform shape (i.e. a shape which when viewed from above in orthographic projection) which is lesser in a first dimension ($L_1$) than it is in a second dimension ($L_2$) perpendicular to the first dimension ($L_1$) (i.e. $L_1 \perp L_2$ and $L_1 < L_2$). The lid 64, in this embodiment at least, is essentially thin, generally planar and rectangular in plan form shape with dimensions $L_1$ (or $L_{across}$)×$L_2$ (or $L_{along}$), where $L_1$ (or $L_{across}$)<$L_2$ (or $L_{along}$), as mentioned above. More specifically, the planform shape of the lid 64 is preferably lesser in the first dimension ($L_1$) than it is in the second dimension ($L_2$) by a factor f, where $0.3 \leq f \leq 0.75$. (i.e. $L_1 = f\ L_2$ (or $L_{across} = f\ L_{along}$, where $0.3 \leq f \leq 0.75$). $L_2$ (or $L_{along}$) should be approximately half the antenna's operating signal wavelength (λ) plus or minus a matching factor (x) of up to 20%. (i.e. $L_{along} = \lambda/2 \pm x$, $x \leq 20\%$). In the particular embodiment presently described and shown in FIG. 11, FIG. 12, FIG. 13, FIG. 14 and FIG. 15, in the direction of the second dimension ($L_2$) the lid extends for approximately 90 mm to 260 mm (i.e. $L_2$=90 mm to 260 mm). Actually, it is envisaged that the embodiment of the antenna depicted may be implemented in practice using an operating frequency of 920 MHz, which means a wavelength of approximately λ=0.326 m. This means that if $L_{along}$=137 mm, which is what is presently considered most desirable for an operating frequency of 920 MHz (and this is considered to be the desirable operating frequency), then x=−0.026 or about 19%. Where $L_{along}$=137 mm, $L_{across}$ may be anywhere in the range from about 40 mm to about 110 mm. In another example though, for an operating frequency of 1 GHz, which means λ=0.3 m, this means that if $L_{along}$=180 mm, then x=0.03 or about 16%. Where $L_{along}$=180 mm, $L_{across}$ may be anywhere in the range from about 54 mm to about 135 mm. For a given length of lid (i.e. $L_{along}$, which is determined with reference to operating frequency) the width of the lid (i.e. $L_{across}$) may be varied or adjusted in order to tune the antenna or adjust the shape of the radiation pattern, as discussed below.

The lid 64 is made from a thin plate of conductive, and preferably fairly stiff and resilient material, typically metal (although other non-mental conductive materials are potentially possible). A range of conductive metals are thought to be potentially suitable, including silver, aluminium, copper and other like metals known for their conductivity. However, whilst it is quite possible that metals such as this that are known for their conductivity (and alloys thereof) may be used, it is thought that it may actually be desirable for the lid 64 to be made from a metal more commonly known more for its strength, but which also has high (or adequately high) conductivity, like e.g. steel or titanium. The reason steel or titanium (or possibly other metals or alloys having generally similar properties to these) are considered to be potentially highly suitable is because, not only are they adequately conductive, but they are also strong and highly resilient (i.e. they "spring back" if deformed, provided of course the deforming force does not cause the material to reach or exceed its elastic deformation or yield stress limit). These metals (i.e. steel, titanium and the like) also have a high fatigue resistance, meaning that repeated elastic deformation should not cause the metal to fatigue (i.e. weaken) quickly. The reason these properties (i.e. strength, resiliency and fatigue resistance) are considered potentially important is because, in the road applications in which the antenna is to be used, the antenna will be frequently run over by vehicles (including large heavy vehicle such as trucks), and this will consequently cause some (even if relatively small) deformation of the various parts of the antenna, including the lid 64, even though the lid 64 is encased and protected within the cover 62.

The size of the lid 64 in the $L_1$ (or $L_{across}$) and $L_2$ (or $L_{along}$) dimensions was discussed above. In terms of thickness, as also mentioned above, the lid 64 is (or it will usually be) a generally thin plate. However, the actual thickness of the lid 64 is not critical. In fact, as has been mentioned elsewhere, the lid 64 is not a radiating component of the antenna. Accordingly, it is quite possible for the thickness of the lid 64 to be changed or varied (e.g. depending on the material used), without affecting the radio/signalling properties/performance/operation of the antenna. Nevertheless, depending on the material from which it is made (and in particular the strength, resiliency, etc, properties) the lid 64 will typically have a thickness ranging from less than a millimetre up to several millimetres. However, as has been said, no limitation as to the actual thickness of the lid 64 is to be implied. Because the lid 64 will generally be fairly thin, it might be thought that it might be quite easily bent/deformed beyond the material's yield stress limit. However, as will be explained below, the lid 64 (as well as being protected beneath the cover 62) is supported underneath by the support block 66, which prevents the lid 64 from being (plastically) deformed beyond the material's yield stress.

Figure 13:
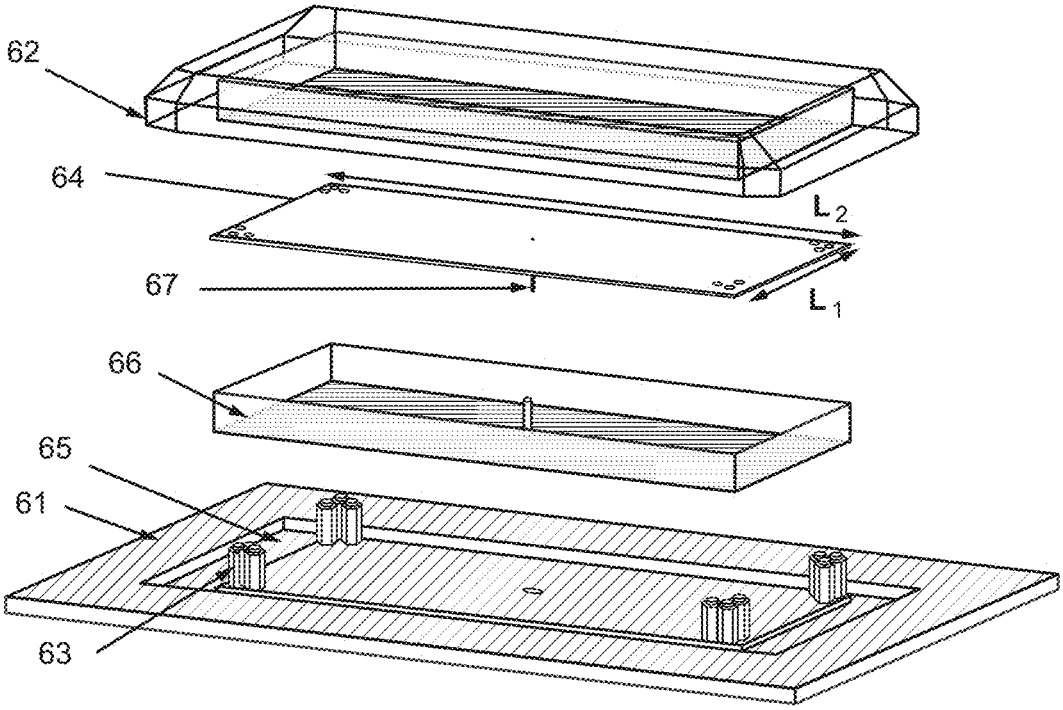

As shown most clearly in FIG. 13, there is a conductive feeder pin 67 associated with (and connected to) the lid 64. As those skilled in the art will appreciate, the feeder pin 67 carries an electric current to the lid 64. However, it is very important to appreciate that the antenna in this embodiment (and in the present invention generally) is NOT a patch antenna (or anything like it). Therefore, whilst the feeder pin 67 carries an electric current to the lid 64, it is not the lid 64 that radiates the energy emitted by the antenna. Rather, as has been explained elsewhere, it is thought that the open side face(s) of the cavity, namely between the ground plane (base plate 61) and the edge(s) of the lid 64 that extend along the long sides of the lid ($L_2$), on either side of the lid, that resonate. It is therefore thought to be these long side gaps between the lid 64 and the base plate 61 that form virtual cavity resonators, and which therefore radiate the energy emitted by the antenna.

In the particular embodiment shown in the Figures, feeder pin 67 connects to the lid 64 (from the underside) at a location that is exactly halfway between the short ends of the rectangular lid (i.e. halfway along the lid 64 in the $L_2$ dimension) and which is also exactly halfway between the long sides of the rectangular lid (i.e. halfway across the lid 64 in the $L_1$ dimension). The lid 64, and the antenna generally, it is therefore "centrally fed" or "centre fed" in the particular embodiment shown.

Figure 11:
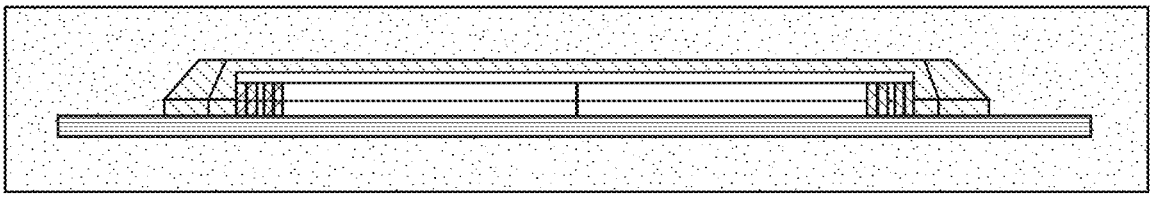
FIG. 11—side-on view of an RFID reader structure (or the portion thereof including the reader antenna structure) in accordance with one possible embodiment of the invention. Note: in this Figure, the base plate (which is part of the ground plane) is shown, but other parts of the ground plane that surround the base plate are not shown. The ground plane, which includes/incorporates the base plate visible in this Figure, sits directly on the road (not shown.
Figure 12:
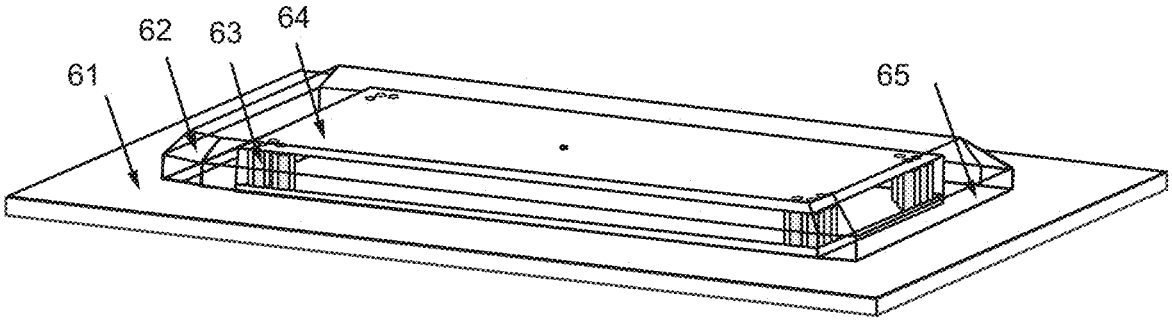
FIG. 12—perspective view of the RFID reader structure (or the portion thereof including the reader antenna structure) in accordance the same embodiment.

As shown in FIG. 11 and FIG. 12 in particular, when the RFID reader antenna structure is assembled, the lid 64 is mounted relatively above, but parallel to, the base plate 61, and it is supported in this position by four pillars 63. The pillars 63 are conductive, and they therefore serve to conductively connected the conductive base plate 61 (and therefore the ground plane) to the conductive lid 64. In terms of the materials from which the pillars 63 may be made, the same general considerations apply as discussed above in relation to the lid 64, and the same materials may potentially be used (although it is to be clearly understood that the material used for the pillars 63 need not necessarily be the same material used for the lid 64). There is one pillar 63 provided for (and beneath) each corner of the rectangular lid 64. Each pillar 63 is actually made up of three sub-pillars, as can be most clearly appreciated from FIG. 13. In the case of each of the pillars 63, the three sub-pillars that make up the pillar are arranged with:

- one of the sub-pillars right in the corner, i.e. forming a corner sub-pillar
- a second sub-pillar immediately adjacent (i.e. very close to, if not in direct contact with) the corner sub-pillar on the inward side thereof in the $L_1$ direction, and
- a third sub-pillar immediately adjacent (i.e. very close to, if not in direct contact with) the corner sub-pillar on the inward side of the corner pillar in the $L_2$ direction.

Thus, on each of the pillars 63, the three sub-pillars together define a corner (specifically a right angled corner), and these corners help to correctly and securely locate the support block 66, which is in the shape of the rectangular prism and has dimensions in the $L_1$ and $L_2$ directions sized to just fit (i.e. it fits snugly) between the pillars 63, so that the corners of the rectangular support block 66 slot into the corners defined by the pillars 63. The support block 66 will be discussed further below.

As will be appreciated, in simple terms, it is the height of the pillars 63 that defines the size of the vertical separation between the ground plane (base plate 61) and the lid 64. The height of the pillars 63 therefore plays a significant role in defining (and adjusting their height can be used to tune the antenna by altering) the size in the vertical dimension of the gaps, both along the long and the short sides of the lid component, between the lid component 64 and the ground plane (base plate 61). However, it should also be borne in mind that, in this particular embodiment at least, the base plate 61 has a recessed portion 65, and the pillars 63 are located within this recessed portion 65. Actually, the pillars are located on a very slightly raised platform that is itself formed in the base of the recessed portion 65. Thus, the pillars 63 extend between the upper surface of the base plate 61 where they connect to the base plate 61, which is within the recessed portion 65, on the slightly raised platform portion, and the underside of the lid 64. It is therefore perhaps correct to say that, in this embodiment, it is the vertical height of the pillars 63, together with the depth of the recess 65 (and the height of the raised platform) in the base plate 61, that defines the "effective" vertical dimension/size of the long side (and short side) gaps, namely the gaps on the long and short sides between the lid 64 in the upper surface of the base plate 61 on the portions of the base plate that surround the recessed portion 65.

In fact, it is actually thought that the recess 65 in the base plate 61, as well as providing structural outer support for the cover 62, also has some influence on the antenna's radiative properties. In particular, it is thought that the depth of the recess 65, and more specifically the consequent height of the short, vertical perimeter wall of the recess 65, may influence how much the antenna's radiation is concentrated below the angle of elevation of the path of maximum gain (all around the antenna in the azimuth plane). Concentrating the antenna's radiation low down, including below the angle of elevation of the path of maximum gain, is advantageous for reasons that have been explained previously. It is thought that if the depth of the recess is made greater (deeper), such that the height of the perimeter wall of the recess is made greater (higher), this may have the effect of concentrating more of the antenna's radiation below the angle of elevation of the path of maximum gain. Conversely, if the depth of the recess is made less (shallower), such that the height of the perimeter wall of the recess is made less (lower), this may, it is thought, have the effect of causing less of the antenna's radiation to be concentrated below the angle of elevation of the path of maximum gain. As a further possible alternative, instead of (or possibly in addition to) making the depth of the recess 65 in the base plate 61 deeper in order to increase the height of the recess' perimeter wall and thereby concentrate more of the antenna's radiation pattern down lower below the path of maximum gain, it may instead (or also) be possible to incorporate into the antenna structure one or more additional components or conductive elements that serves as a "wall extension" (i.e. a height extension for the perimeter wall of the recess 65). A single such component or element could be, for example, a narrow strip of metal (or conducting material) formed into a "loop" that is placed onto the base plate 61 immediately above the perimeter wall of the recess 65 and which extends around in the shape of and immediately above the perimeter wall of the recess 65, such that the inner surface of this loop effectively forms an extension of (i.e. it increases the effective height of) the perimeter wall of the recess 65 itself. Alternatively, as it may not be necessary or important to provide a height extension for those parts of the recess perimeter wall which are at (or below) the short end gaps (i.e. below the short end edges of the lid), because the short end gaps are non-radiating, it may therefore be possible to provide, say, a pair of narrow strips of metal (or conducting material) which are placed onto the base plate 61 immediately above those parts of the recess perimeter wall which are at (or below) the long side gaps (i.e. below the long side edges of the lid) and which extends along and immediately above the long edge lengths of the perimeter wall of the recess 65, such that the inner surfaces of these strips effectively form extensions of (i.e. they increase the effective height of) the long edge lengths of the perimeter wall of the recess 65. Such component(s) or element(s) could be provided as separate, additional component(s) of the antenna structure, or alternatively it/they could be incorporated into one of the other components, such as by being incorporated into the cover 62, such that the component(s) become correctly positioned relative to the perimeter wall of the recess 65 when the cover 62 is installed. In any case, providing such component(s)/element(s) (or something similar) may serve to effectively increase the height of the (relevant parts of the) perimeter wall of the recess 65, without necessarily increasing the actual depth of the recess 65 itself (or not by as much as the height of the (parts of the) wall is effectively increased), and thereby helping to cause more of the antenna's radiation to be concentrated at an angle of elevation below the path of maximum gain.

It should also be recognised, however, that the extent to which the depth of the recess 65 can be increased (i.e. made deeper), or effectively increased by the introduction of additional component(s)/element(s) (say), etc, may be limited due to the very limited overall height of the antenna structure and its components, which may actually allow for only limited variability/adjustment in this regard. Also, it should also be borne in mind that, because it is thought to be the long side gaps that resonate, and because the resonant properties of these are thought to be determined not only by the length in the $L_2$ dimension of the lid (or the distance between the pillars 63 in the $L_2$ dimension) but also at least in part by the vertical separation between the ground plane (base plate 61) and the lid 64 (which is essentially what defines the effective height of the long side gaps as discussed above). Therefore, because the height of the long side gaps is also thought to be important in determining (and providing) the antenna's resonant properties, the extent to which alterations may be made which affect this height (i.e. the height or effective height of the long side gaps) may be further limited by the need or desire not to overly impede or compromise these resonant properties for the antenna's tuning.

On each of the four pillars 63, there are small round detents or lugs on the top of each of the three sub-pillars. Also, in each corner of the lid 64, there are three holes all of a diameter corresponding to the diameter of the lugs on top of the sub-pillars, and the three holes in each corner of the lid 64 are formed in a corresponding arrangement to the arrangement of the lugs on top of the sub-pillars on the respective corresponding posts 63. Therefore, when the lid is placed on top of the pillars 63, the lugs on top of each pillar insert into the holes in the respective corners of the lid thereby correctly locating the lid 64 relative to the pillars 63 (and relative to the recessed portion 65 in the base plate 61, etc). Note that the corners of the lid, where the pillars connect thereto, are locations of ground potential (or nulls) in the lid, and it is significant that the pillars connect at locations of ground potential or nulls.

The antenna pillars 63 (or one or more of them, or one or more sub-pillars of one or more of the pillars 63) may be hollow along the length thereof. For example, there could be a through-bore extending axially through the (or each) relevant sub-pillar. This hollow interior extending through the one or more sub-pillars may provide one or more conduits for cables, wires or the like to extend from below the base plate 61 (or otherwise below the ground plane) and connect to any electronic parts and/or equipment that may be located, say, in a space that may be provided above the lid 64 but below the underside of the protective cover 62. A space for other electronic parts and/or equipment might also or instead be provided, say, adjacent but just outside/beyond the short side gap on one or both ends of the lid 64, but still within the confines of the cover 62 when the coverage installed. Or indeed, electronic parts and/or equipment could also be located at a range of other locations provided this does not substantially interfere with the radiative properties of the main antenna. These electronic parts and/or equipment could include any electronics associated with the RFID reader, e.g. like a modem or filters or amplifiers or the like, or communication equipment such as a supplemental Wi-Fi or Bluetooth antenna, etc, or illuminating component as discussed elsewhere herein.

It was mentioned above that the RFID reader antenna structure includes a support block 66. It was also explained that this support block is sized so as to fit snugly between the corners defined by the respective pillars 63. The support clock 66 resides beneath the lid when the antenna structure is assembled, and together with the posts 63, the support block 66 helps to provide structural support for the lid 64. Because the support block 66 is located beneath the lid 64, the support block 66 must of course be installed on the base plate 61 between the pillars 63 before the lid 64 is mounted on top of the pillars 63. Actually, when the antenna structure is assembled, after the base plate 61 has been initially installed on the road and the pillars 63 have been installed on the base plate 61, the support block 66 can then be inserted between the pillars 63, as discussed above. The thickness of the support block 66 in the vertical dimension is such that the support block 66 fills (in the vertical direction) the space between the underside of the lid 64 and the upper surface of the (slightly raised platform within the recess 65 in the) base plate 61.

Therefore, as mentioned above, the pillars 63 and the support block 66 together help to provide structural support for the lid 64 in its position mounted above and parallel to the ground plane. As mentioned above, the posts 63 will typically be made from metal, and they therefore provide a quite ridged support beneath each of the four corners of the lid 64. The support block 66, which fills the entire space inside the corners defined by the pillars 63 and between the base plate 61 and the underside of the lid 64, and which is therefore in contact with both the base plate 61 and the underside of the lid 64, may be made from a wide range of different materials. The support block 66 is not a conductive or radiating component of the antenna, and it should therefore be substantially non-conductive (or at least substantially non-conductive at the frequencies at which the antenna operates). Preferably, the support block should be made from a material that has appropriate dielectric properties, preferably a low dielectric constant with uniform dielectric properties throughout the material. Also, in order to help support the lid 64 above, and specifically in order to help support the inner portions of the lid 64, inwards from the four (rigid/stiff) corner pillars, against downward deformation (as may occur when a large load is applied from above, as when a vehicle runs over the antenna, etc) the support block should be made from a solid material of some kind. However, the support block 66 need not necessarily be a highly rigid material (i.e. not necessarily like the strong material from which the protective cover 62 is formed, or anything like that). Instead, the support 66 may be made, and indeed it may be desirable for it to be made, from a material which, whilst solid, also has a reasonable degree of resiliency or "give". Possible examples of such materials include closed cell foams like styrofoam or the like, or paper or cardboard formed with a cellular (or honeycomb) like structure, or indeed possibly a range of other materials of the kind commonly used as padding in packaging around objects, consumer appliances and the like when they are shipped. The reason materials such as this, which are solid but which also have a reasonable degree of give or deformability, may be suitable (or even desirable) can be understood by first remembering that the lid 64 is a fairly stiff (typically metal) plate. The lid 64 also lies directly on top of the support 66 and the underside of the lid 64 is in contact with the entire upper surface (or most of it) of the support 66. Therefore, when a vertically downward load is applied to the antenna structure, and if this is sufficiently large to cause deformation of the protective cover 62 and also of the lid 64 underneath (and anything located in between the underside of the cover 62 and the upper surface of the lid 64), then if this load causes downward deformation or flexure of the lid 64, even if the load (after passing through or being transmitted by the cover 62 etc) becomes applied only to a small/localised region somewhere in the middle of the lid 64 (between the corners which are supported by the stiff pillars 63), the fact that the lid 64 is itself fairly rigid will help to cause that localised load to be distributed and borne by a much greater area of the support 66 underneath. This will, in turn, cause that greater area of the support 66 to become compressed, and the compression may also spread out through the material of the support 66 in such a way that an even larger proportion (if not the whole of) the support 66 underneath the lid 64 helps to bear the load (even if the load is applied as a fairly localised load where it is transmitted onto the lid 64).

It was mentioned above that it may in fact be preferable for the support 66 to be made from a material which, whilst solid, also has a reasonable degree of resiliency or "give". The reason this may be preferable over, say, a highly rigid material is because highly rigid materials are (generally by their nature) less resilient (i.e. less flexible or able to deform). Many are even brittle or susceptible to fracture. As a result, if a highly rigid material were to be used for the support 66, this could potentially be susceptible to cracking, or possibly to fatigue failure over time. Therefore, whilst no limitation whatsoever is to be implied as to what material may be used for the support 66, it is considered that it may often be preferable for the material to have a degree of resiliency or give, rather than being very highly rigid, as this may in fact perform better in providing support beneath the lid 64.

The protective cover 62, which as mentioned above, takes the form of a transparent, generally flat and rectangular "dome" made of a strong/structural (and transparent or translucent) material such as polycarbonate or the like, is installed over the top of the lid 64, and hence over the support 66, pillars 63, etc, located beneath the lid 64. The protective cover or "dome" 62, as well as serving a structural protective function, may actually also function as a radome. (According to Wikipedia: "a "radome" (which is a portmanteau of radar and dome) is a structural, weatherproof enclosure that protects a (e.g. radar) antenna. [A] radome is constructed of material that minimally attenuates the electromagnetic signal transmitted or received by the antenna". However, further in addition to this, the protective cover 62 may also serve (along with the ground plane) to lower the antenna's radiation pattern (i.e. reducing the elevation angle of the path of maximum gain and directing the bulk of the radiation (i.e. concentrating the radiation) to the area below the path of maximum gain, between the path of max gain and the ground plane).

Incidentally, the path of maximum gain, in elevation, of the antenna's radiation pattern, and the radiation distribution above and below the path of maximum gain, are significantly influenced by the height of the long side gaps (this has been explained previously) and also significantly by the ground plane which is proportionally much more massive than the lid component. However, in further addition to this, the material thickness and the angle of attack (i.e. the angle of slope) of the long side edges of the cover 62, and the dielectric value of the material from which the cover 62 is made, may (it is thought) further effect the elevation angle of the path of max gain and the radiation distribution above and below the path of maximum gain. Therefore, these properties, namely the angle of slope of the long side edges of the cover 62, and the material thickness of the cover along these long sides, and the dielectric value of the material from which the cover is made, are further properties that can potentially be altered or modified in order to tune the antenna or alter its radiation pattern. However, again, the extent of possible alteration or variation that may be possible may often be limited by other considerations. For example, the ability to alter or make adjustments to the angle of attack (i.e. the angle of slope) of the long side edges of the cover 62 may be restricted significantly by the need to maintain an angle of slope which provides adequate safety for vehicle wheels which might contact and roll over the cover 62, and this may also be affected by the provisions of applicable road safety regulations and the like.

In order to fit over the other components, the protective dome 62 has a generally rectangular-prism-shaped opening formed in its underside. This opening in the underside of the dome 62 is most clearly visible on its own in FIG. 13. The way in which the other components of the RFID reader antenna are received within this opening in the underside of the dome 62, when the dome is installed thereon, is clearly shown in FIG. 11, FIG. 12 and FIG. 14. Thus, when the dome 62 is installed over the other components, the outer perimeter portions of the dome 62 (i.e. those perimeter portions which surround and between them define the opening in the underside of the dome 62) extend down and cover the top and sides of the other components. In fact, the dome is mounted in contact with the base plate 61 in a manner that forms a seal preventing the ingress of moisture, dirt or other contaminants into the inside thereof where the other components are housed. Appropriate sealants or adhesives may be used to form this seal between the peripheral undersides of the dome 62 and the base plate.

The way in which the outer perimeter base portions of the dome 62 are supported by the vertical sides of the recess 65 in the base plate 61 has been explained above.

It is an important aspect of the design of the RFID reader antenna in this particular embodiment that when the RFID reader antenna structure is fully assembled (i.e. when the dome 62 has been finally installed to form a protective cover over the other assembled components), the total "real" height of the resulting structure is less than 25 mm, more preferably around 20 mm. In this regard, the "real" height means the vertical distance between the upper surface on the base plate 61 in the areas immediately surrounding (i.e. on the outside of) the dome 62 and the top surface of the dome 62. By way of example, if the "real" height of the assembled antenna structure is 20 mm, the actual height of the dome 62 could be a few millimetres greater than this, however it will be noted that, like other parts of the antenna structure, the dome 62 is received into the recessed portion 65 in the centre of the base plate, so even if the vertical height of the dome 62 is slightly greater than 20 mm (perhaps 21-23 mm), nevertheless the "real" height of the overall antenna structure (which is the height that it will appear to have from the point of view of a vehicle approaching it) will still only be 20 mm.

Limiting the height of the overall RFID reader antenna structure to less than 25 mm, and preferably around 20 mm, is important because, as discussed above, government and regulatory authorities responsible for authorising the installation and/or use of any form of equipment (or objects of any kind) on or near public roads are often highly conservative and therefore highly wary of allowing the installation and/or use of new types or forms of equipment which have not been used previously on public roads, particularly if the form (i.e. the size and/or shape and/or general configuration or appearance, etc) of the new equipment is unfamiliar, unconventional or different to types or forms of equipment that have previously been authorised for use. However, in this regard, in most countries/jurisdictions, the regulatory authorities responsible for authorising the installation and use of equipment on roads have granted permission for the installation and use of conventional retroreflective ("cat eye") road markers, like those depicted in FIG. 9 and FIG. 10, and these are indeed used extremely widely. Importantly, the height of these conventional retroreflective road markers is typically about 25 mm. Thus, the RFID reader antenna structure presently described will have a height no greater (and possibly less than) that of conventional retroreflective road markers which are widely authorised for use, commonly accepted and used.

Figure 9:
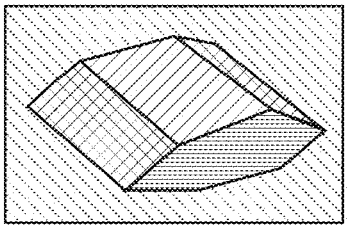
Figure 10:
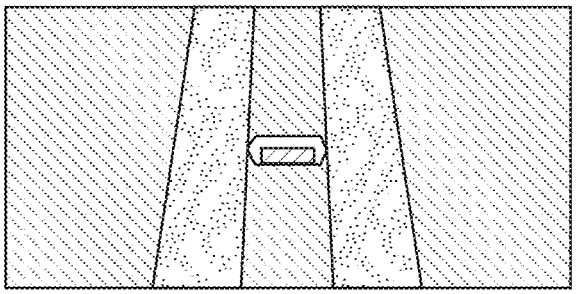
FIG. 10—perspective view of a typical conventional retroreflective ("cat eye") road marker installed on the road (between double lines separating adjacent road lanes).

It should be noted that, in a direction parallel to the direction in which vehicles travel along a road, the total length of the protective cover/dome 62 will often be considerably longer (typically several times longer) than the typical length in this direction of a conventional retroreflective ("cat eye") road marker like the ones shown in FIG. 9 and FIG. 10. However, in a direction perpendicular to the direction which vehicles travel along the road (i.e. in a direction across the road), the total width of the protective cover/dome 62 will be roughly the same as (or possibly smaller than) the width of a conventional retroreflective road marker. And importantly, from the point of view of an oncoming vehicle (or the vehicle's drivers), it is the width (i.e. the size in a direction across the road), as well as the height, of an object on the road that determines the apparent size of that object (i.e. it is the width and height of the object on the road that largely determines how big that object appears to be from the point of view of the driver of the oncoming vehicle). The length of the object in a direction parallel to the direction of vehicle travel is generally much less significant in providing the driver of an oncoming vehicle with an appreciation for the size of an object they are approaching on the road, and in fact given the viewing angles involved when the object is viewed by the driver from a distance away from the object, the driver may not even be able to fully appreciate how long the object is in the direction parallel to the direction of vehicle travel. Therefore, even though the protective cover/dome 62 of the antenna structure in the present embodiment, which is what determines its apparent size from the point of view of a driver of an oncoming vehicle, is longer than a conventional retroreflective road marker, nevertheless this is much less significant (and it may not even be noticed) by the driver, who will comprehend the size of the object (the cover 62) based on its width and height, and from this it (the cover 62) will appear to be essentially little or no different in size and shape than a conventional retroreflective road marker (which they are perfectly accustomed to seeing and driving over).

To put this another way, in the example presently described, the RFID reader antenna structure is installed such that it is one of the short edges of the rectangular RFID reader antenna structure (i.e. one of the edges parallel to the lid's $L_1$ dimension) that points along/up/down the road. Therefore, from the point of view of a vehicle (and its driver) approaching the RFID reader structure, it is this short edge (and in particular the short edge of the cover 62) that the vehicle (and its driver) will "see". For reasons discussed above, even for a given length of the lid 64 ($L_2$, which is determined according to antenna operating frequency), the antenna with ($L_1$) can still vary. However, it is anticipated that the width ($L_1$) of the lid 64 will often be less than 100 mm, and often less than 90 mm (widths of around 75 mm to 80 mm are expected to be typical). As can be seen from FIG. 12 and FIG. 13, the width of the cover/dome 62 parallel to the lid's $L_1$ dimension will be somewhat larger than the lid's $L_1$ dimension. This is because the dome 62 extends beyond, and overhangs, the lid 64 on both sides in the $L_1$ direction (in fact the dome 62 overhangs the lid on all sides). Nevertheless, if it is assumed that the width of the lid 64 is 80 mm and that the dome 62 extends beyond this by 20 mm on either side in the $L_1$ dimension, this means that the total width of the RFID reader antenna structure "as seen" (i.e. from the point of view of) an approaching vehicle will be approximately 120 mm. This, again, is approximately the same as the width of conventional retroreflective road markers which are widely authorised for use, commonly accepted and used.

It is also important that the edge of the structure which a vehicle "sees" as it approaches, namely the forward facing edge of the cover 62, is a straight edge (i.e. this edge extends in a straight line across the road from the point of view of an oncoming vehicle). This is important because this is actually quite different to, e.g., the alternative RFID reader antenna structure previously proposed in patent application '994 above, which was an RFID reader antenna structure having an overall circular plan form shape. As a consequence, in the case of the RFID reader antenna structure previously proposed in patent application '994, the edge of the structure which a vehicle would "see" as it approached along the road is a curved, rather than straight, edge. And in fact, in the case of the RFID reader antenna structure previously proposed in patent application '994, the edge of the structure which the vehicle's wheel/tire would initially struck/contact upon driving over the antenna structure would also (naturally) be a curved, rather than straight, edge. For vehicle such as cars, trucks and the like, this is not perceived to be a significant problem. However, there is at least a perception that this might be problematic for vehicle such as, for example, motorcycles, bicycles and the like, for which there is perceived to be a danger that if the vehicle's front wheel were to strike the curved edge at a slight angle (i.e. at an angle other than perfectly "direct on" to the edge), this could cause the vehicle's front wheel to be knocked off course, potentially leading to accident and injury. However, in the antenna structure in the embodiment presently described, this problem is resolved or moot, because the edge of the structure which a vehicle "sees" as it approaches (i.e. the forward facing edge of cover 62) is a perfectly straight edge extending directly across the road, and so again, the antenna structure in the present embodiment should be perceived to create no more danger on the road than a conventional retroreflective road marker of the kind commonly accepted and used (and which are deemed not to pose an unacceptable risk).

Furthermore, it can be seen from FIG. 11, FIG. 12, FIG. 13 and FIG. 14 that the sides of the dome 62, whilst straight along their length, are not simply straight, vertical sides. Rather, there is at least an upper portion on each of the sides of the dome 62 (and this typically extends for more than half the height of the dome) which slopes inwardly and upwardly. It should generally be the case that the amount by which the dome 62 extends out and overhangs the other components of the antenna is sufficient to allow these sloped portions to have a slope of about 45° or less relative to the plane of the base plate/ground plane/road. This (along with the height which is limited to 25 mm or less) may help to allow the wheels of cars and other road going vehicles to roll over the said devices without an undue jolt or impact. And again, this angle of slope of the upper portions on the sides of the dome 62 is similar to that which is widely used and accepted (and deemed not to pose an unacceptable risk) on conventional retroreflective road markers. Also, as mentioned above, in addition to helping the wheels of cars and other vehicles roll over the device without an undue jolt or impact, the angle of attack (i.e. the angle of slope) of the sloped portions of the long side edges in particular of the cover 62, and the material thickness along the long sides and the dielectric value of the material from which the cover 62 is made, may effect the elevation angle of the path of max gain in the antenna's radiation pattern and the radiation distribution above and below the path of maximum gain.

Note that, whilst it has been suggested that polycarbonate, or acetal, or the like, may be a particularly suitable material to use in making the protective cover/dome 62, no absolute limitation is to be implied in this regard. Indeed, there are potentially a range of other structurally strong and dielectrically suitable materials that could also be used, and any of these may indeed be used.

Without limitation to the foregoing, it has been mentioned that the reason why polycarbonate has been selected as one possible material from which the protective cover (dome) 62 may be made is due to the strength of this material (and also its durability, toughness, resistance to UV on other elemental degradation) and consequently the protection it can therefore provide for the lid 64 and other components of the antenna covered thereby. However, the use of polycarbonate may have the additional benefit that this material can be made transparent or translucent or at least somewhat permissive to penetration by light. The reason this may be beneficial is because, included among other electronic parts or components that may be provided in or as part of the RFID reader, there may be one or more components that incorporate lights, LEDs or the like and which, when illuminated, are visible from outside the RFID reader and even from a distance away from the RFID reader (especially at night or in low light conditions). These lights or LEDs (or indeed other electronic components) could be housed in a small space that may (sometimes) remain between the upper surface of the lid 64 and the underside of the dome 62, or possibly they could be mounted inside hollows or openings formed in one or more of the peripheral portions on the dome, i.e. horizontally out from the other antenna components that have been described. In any case, such lights or LEDs could be used, for example, to provide indications as to the current operational status of the RFID reader or individual parts or functions of it. For instance, as a simple example, a red light/LED could be provided which "turns on" in situations where there is a fault or malfunction or warning associated with the operation of the RFID reader (e.g. where there is a component malfunction, or a power supply failure or disruption, or an "almost empty" battery or backup battery, etc). However, such lights, LEDs or the like which may be contained within (but visible from without) the RFID reader might also be used for a range of other purposes. For example, because the RFID reader in these applications is positioned on the surface of the road (i.e. on the surface on which vehicles are travelling and to which the vehicle's drivers are paying close attention), LEDs or lights in the RFID reader may also be used to provide various forms of signalling to vehicles. For example red and green lights could be used for indicating lanes that are open or closed for vehicle travel, or for indicating the permitted direction of travel in a lane (this last might be useful e.g. in places which implement "tidal flow" traffic management which facilitates vehicular travel, within a given lane, in different directions at different times of day, to help accommodate large volumes of traffic flow in one direction or other at different times of day). There could also be other possible uses, for example a flashing light could be used to provide a warning to road users of an upcoming incident or danger further down the road. Or, red, yellow and green signals could be provided in an RFID reader located just before an intersection with traffic lights, and the red, yellow or green lights in the RFID reader could be changed instantaneously/simultaneously and correspondingly with the change in signal at the traffic lights. The illumination of, or light signals emitted from, any lights or LEDs inside the RFID reader could also be visible and detectable to cameras or other imaging devices, for example those located at the side of the road and used for law enforcement or traffic management purposes. It will be appreciated that the possible uses mentioned above for lights, LEDs or the like which may be provided in or as part of the RFID reader are merely examples, and there may be many other uses or applications for this.

Where the cover 62 is instead made from a material, like e.g. acetal, which is not necessarily transparent or translucent, light guides may be provided within the cover 62 to still allow LEDs or the like to be used in a similar manner to that described above.

Figure 14:
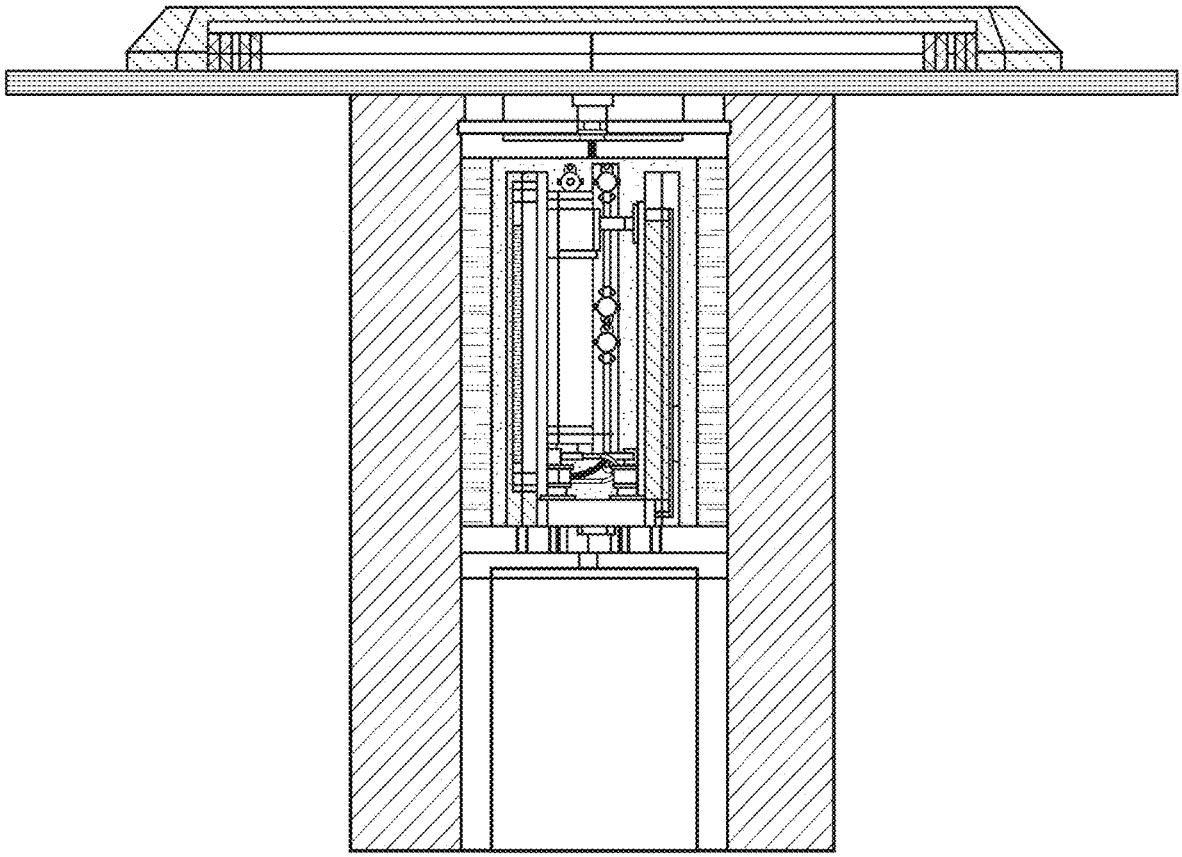
Figure 15:
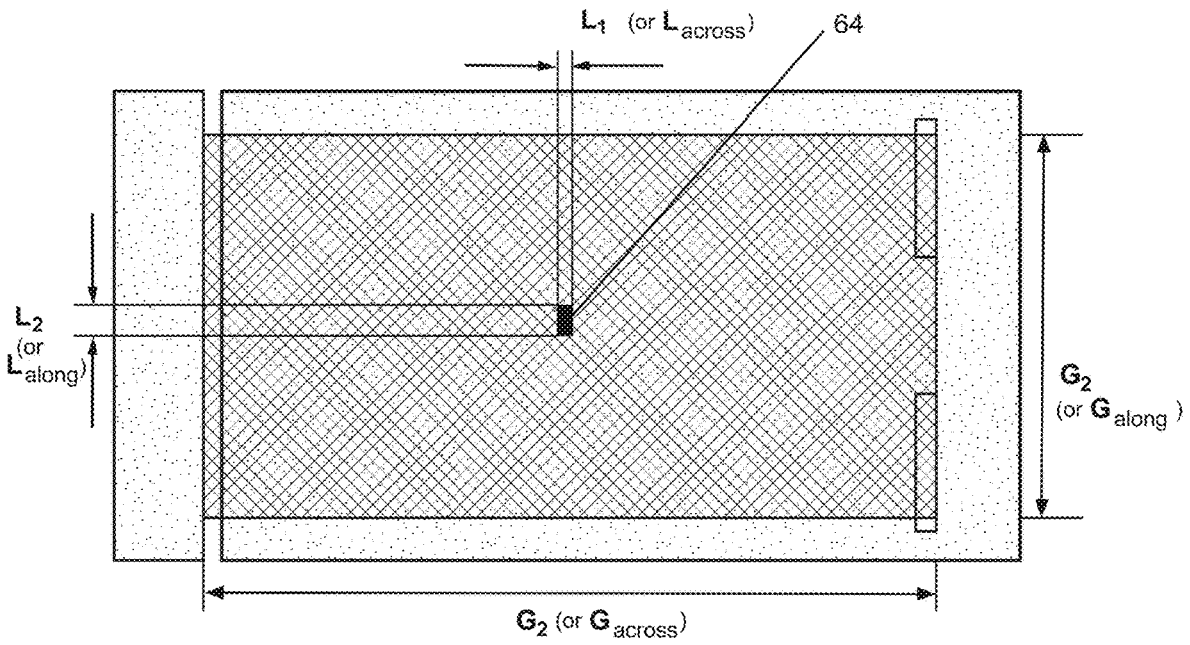
FIG. 15—schematic illustration of the dimensions of the ground plane and of the antenna's lid component relative to a single road lane. Note that this Figure shows the whole ground plane and also the lid component, but other components such as the protective cover, base plate, etc, are not illustrated FIG. 16—graphical representations of the shape and strength/power of the radiation pattern produced by an antenna in accordance with one possible embodiment of the invention.

It is to be noted now that FIG. 14 is a view of an RFID reader which incorporates the proposed antenna as well as other RFID reader equipment that is not shown in FIG. 11, FIG. 12 and FIG. 13. It should also be noted from the outset that FIG. 14 depicts a situation where at least some parts of the RFID reader, and other associated equipment, are located at or below the level of the road surface, whereas other parts (particularly parts associated with the antenna that have been described in detail above) are located on or above the level of the road surface. And as will be readily appreciated, FIG. 14 is a side-on cross-sectional view, and hence parts of the RFID reader as well as other associated equipment which are located both above and below the level of the road surface can be seen. The particular parts and electronics of the RFID reader shown in FIG. 14 will not be discussed in detail herein; however these are essentially the same as (or at least similar to) the parts and electronics associated with the RFID reader described in earlier patent application '994.

Whilst FIG. 14 depicts a scenario where at least some (and in that case most) of the parts and electronics associated with the RFID reader are buried beneath the level of the road, below the antenna, it is to be clearly understood that no limitation is to be implied as to what the various parts and electronics are, and how and where they may be mounted. Hence, parts and electronics associated with the RFID reader need not necessarily be buried beneath the reader antenna. Indeed, in other embodiments, electronics associated with the RFID reader could, instead, be located (say) to the side of the road and connected to the antenna located in the middle of the road (or the road lane) by wires or cables installed into small slots or channels which are initially cut into the road and then covered over after the cables have been installed.

It is discussed elsewhere herein that RFID readers, and this includes readers incorporating the presently-proposed antenna structure, may be used to provide not only "two-way" data exchange but also "one-way" (or RADAR-like) data exchange. It is further explained elsewhere that "one-way" data exchange in particular, may be useful for the purposes of vehicle detection. The presently-proposed RFID reader may make use of this, in particular, because the amount of power required for two-way communication can be much more than for one-way communication. Accordingly, vehicle detection achieved using "one-way" data exchange could be used, for example, to help minimise power consumption by enabling the RFID reader to operate normally in the lower-powered one-way communication mode, and then only switch to the higher-power two-way communication mode (by switching on the RF communication equipment required for this) when a vehicle is actually detected by a one-way data exchange occurrence, and hence only when the need for actual/positive vehicle identification is required. (The duty cycle in the RFID reader equipment will preferably be such that the high power RF communication equipment required for two-way data exchange can be turned on in a matter of milliseconds, so even if a vehicle is only detected when it is, say, 6 m from the antenna, the time delay in switching on the high power RF equipment should not prevent proper vehicle identification via RFID ("two-way" data exchange), especially if the vehicle is moving at normal road speeds.) In addition to saving power, only using the higher power level required for two-way communication when necessary may also significantly help to reduce heat generation and the risk of overheating in the RFID reader.

In terms of powering the antenna (and the other electronic components incorporated in or associated with the RFID reader), this may be done in any manner of ways. For example, by using an induction loop, or by connecting one or more current (power) carrying cables directly to the RFID reader structure. Such current (power) carrying cables could be installed in shallow slots or trenches formed in the road (e.g. cut/dug in the road and then covered over after the cable has been laid).

Also, communication and data transfer between the RFID reader and other computers or devices which are separate or external from the RFID reader may be achieved, and again, this may be done in any suitable way. Due to the rugged environment and the permanent (or at least semi-permanent) nature of the installation in "on-road" applications, simply connecting a cable (like an ethernet cable or the like) may often not be suitable for achieving data transfer. However, other conventional wireless communication methods (e.g. Wi-Fi, Bluetooth, etc) may be used, or if the RFID reader is powered by a power cable then conventional "data over power" methods may also be used for communicating. Where a wireless communication method is used, e.g. Wi-Fi or Bluetooth, an additional antenna may be required to support this. Such an antenna could be incorporated somewhere inside the dome of the RFID reader.

Figure 16:
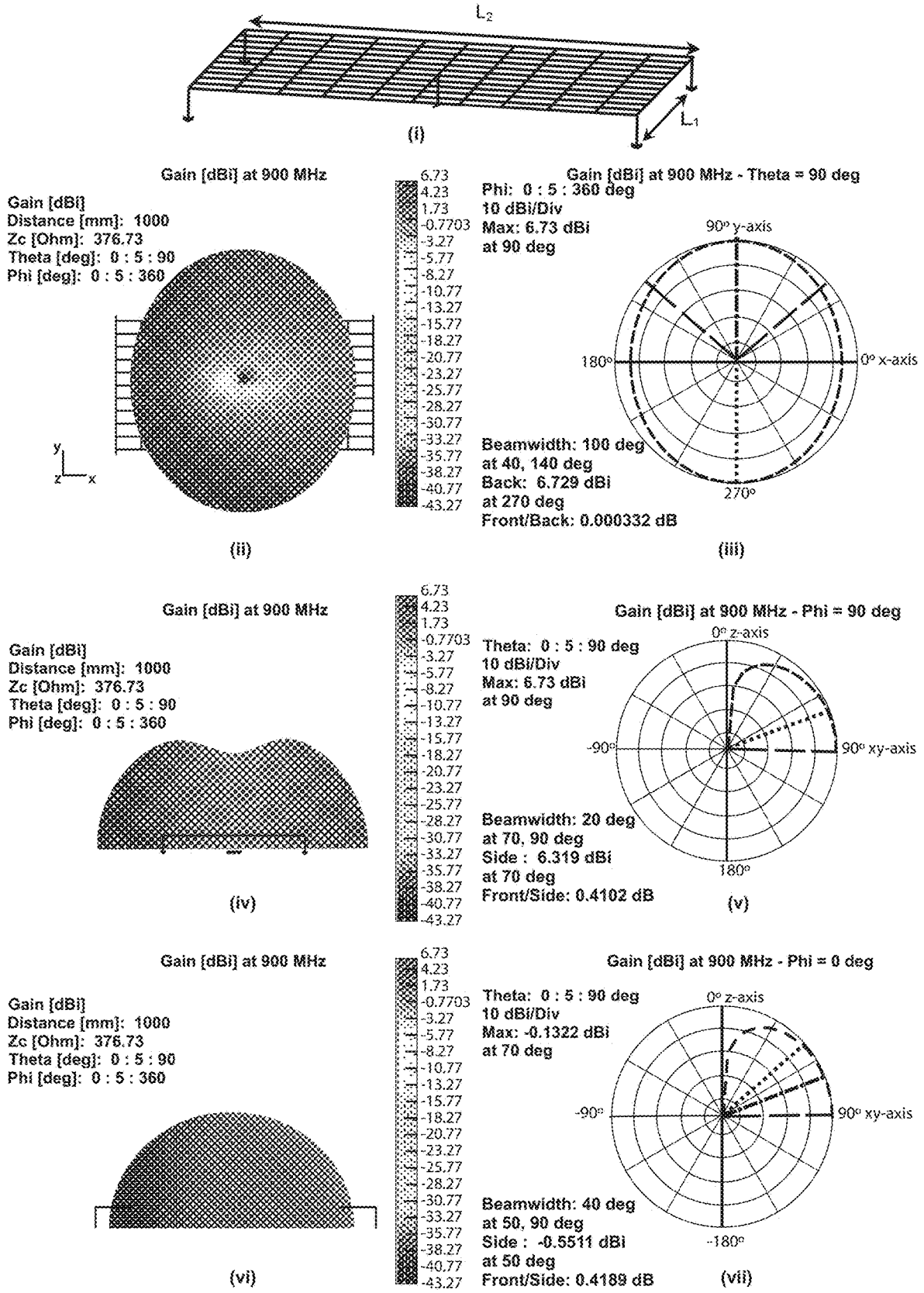
Figure 17:
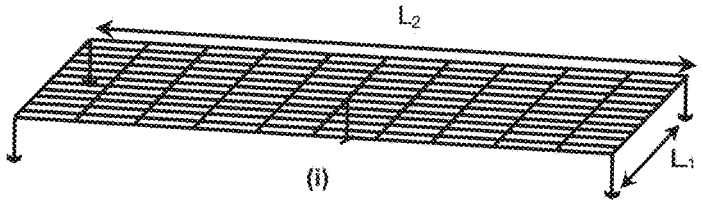
FIG. 17—graphical representations of the shape and strength/power of the radiation pattern produced by an antenna in accordance with another possible embodiment of the invention, different to the embodiment whose radiation pattern is represented in FIG. 16, and which has (in particular) a lid of different length relative to width dimensions compared to the embodiment whose radiation pattern is represented in FIG. 16.
Figure 17:
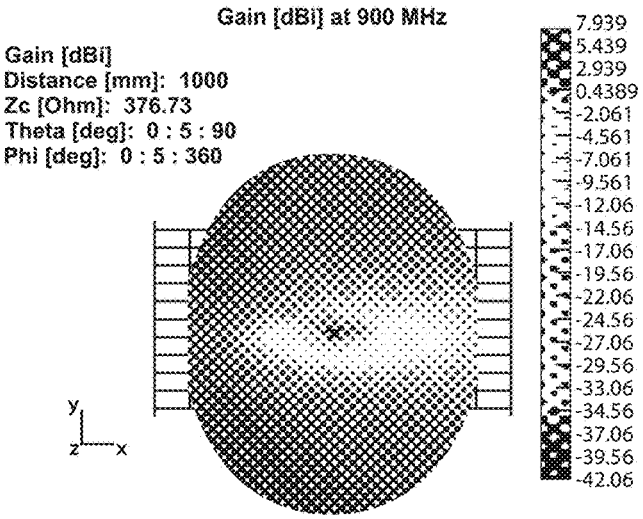
Figure 17:
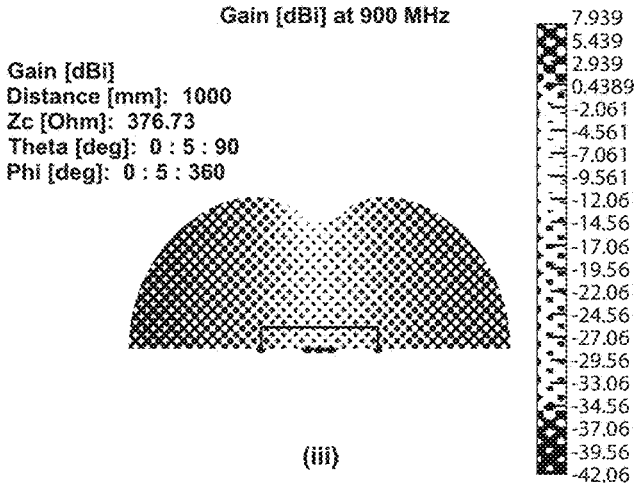

Turning now to FIG. 16 and FIG. 17, these provide graphical representations of the "shape" of the radiation pattern produced by antennas in accordance with embodiments of the present invention. Note that the radiation patterns represented in FIG. 16 and FIG. 17 were produced using a mathematical model; however actual measurements taken from actual prototype antennas in accordance with embodiments similar to the one depicted in FIG. 11 to FIG. 15 appear to confirm the accuracy with which the mathematical model represents actual (real-world) antennas in accordance with embodiments of the invention.

Referring first to FIG. 16(*i*), this is an illustration (i.e. a "wireframe" visualisation) of the geometry of the nodes used in mathematically modelling one particular antenna, and the radiation pattern representations in FIG. 16(*ii*)-(*vii*) were produced from this particular mathematical simulation. Note that there is nothing actually shown in FIG. 16(*i*) which graphically represents the antenna's ground plane; however this is not to suggest that the ground plane is not represented in the mathematical model. In any case, it will be easily appreciated from FIG. 16(*i*) how the geometry of the nodes in the mathematical model (as represented in the "wire-frame" visualisation) correspond to the geometry of the rectangular ($L_1 \times L_2$) lid component 64 supported on the pillars 63 at the four respective corners in the particular antenna being simulated.

In the remainder of FIG. 16:

FIG. 16(*ii*) and FIG. 16(*iii*) are plan form views (i.e. "top-down" views from directly above) of graphical representations of the simulated antenna's radiation pattern, and if the antenna simulated in these views is considered to be located on the surface of a road in the centre of a road lane, the direction of vehicle travel on the road lane would be horizontally from right to left (or left to right);

FIG. 16(*iv*) and FIG. 16(*v*) are end-on views of graphical representations of the simulated antenna's radiation pattern, i.e. as if looking at the antenna's radiation pattern in a direction along/down the road in the direction of vehicle travel; and FIG. 16(*vi*) and FIG. 16(*vii*) are side on views of graphical representations of the simulated antenna's radiation pattern, i.e. as if looking at the antenna's radiation pattern in a direction across the road, perpendicular to the direction of vehicle travel.

As the various views in FIG. 16 illustrate, the simulated antenna's radiation pattern has a shape that extends further across the road (or more in a direction perpendicular to the direction of vehicle travel on the road) than down/along the road. In other words, the antenna emits more energy, or a greater energy density, transversely across the road than it does along the road. And as explained in the Background section above, the effect this may have is that, as a consequence of the geometries of a vehicle's RFID tag antenna radiation pattern and of the RFID reader antenna radiation pattern (whose radiation pattern is depicted in these views), and as a result of the interaction between the two, the effective read zone should, for example, cover the full width of the road lane, as shown in FIG. 7(*ii*), despite any increased directionality of a vehicle's tag antennas' radiation (again, discussed above).

Turning now to FIG. 17(*i*), like FIG. 16(*i*), this is an illustration (i.e. a "wireframe" visualisation) of the geometry of the nodes used in mathematically modelling one particular antenna, and the radiation pattern representations in FIG. 17(*ii*)-(*iii*) were produced from this particular mathematical simulation. However, a very important thing to note about FIG. 17(*i*) is that the actual geometry of the nodes represented is different to the geometry represented in FIG. 16(*i*). More specifically, in FIG. 17(*i*), the shape/geometry with which the lid component 64 is simulated, as defined by the length:width (i.e. $L_1$:$L_2$) ratio of its rectangular shape, is different to the shape/geometry with which the lid component 64 is simulated in FIG. 16(*i*). Thus, FIG. 17(*i*) shows that the particular antenna simulated therein and whose radiation is represented in the other view is FIG. 17 has a different geometry to the antenna simulated and represented in FIG. 16, and this is why the shape of the radiation pattern depicted in FIG. 17(*ii*)-(*iii*) differs from the shape of the radiation pattern depicted in FIG. 16(*ii*)-(*vii*). And indeed, a comparison of FIG. 16 with FIG. 17 provides an example of the way in which the geometry of the present antenna (and in particular the relative length:width ratio of the antenna's rectangular lid component) can be altered in order to alter the shape of the radiation pattern produced by the antenna. In the particular example given by FIG. 17, the particular antenna simulated therein has a lid component geometry that is thinner (i.e. narrower in the $L_1$ dimension) than the particular antenna simulated in FIG. 16, and the result of this geometry change is (at least in simple terms) to cause the antenna's radiation pattern to extend even more across the road (or even more in a direction perpendicular to the direction of vehicle travel on the road) and even less down/along the road in comparison.

An important point to note, in the simulations in both FIG. 16 and FIG. 17, is that the radiation pattern has a "null" (or at least a virtual/effective null) located above the geometric centre of the lid component—this can be seen most clearly in FIG. 16(*ii*) and FIG. 17(*ii*). The reason this is important is because it means that, moving inward towards the centre of the antenna in any radial direction, the overall shape of the antenna's radiation pattern effectively "curves over" (or the density of the energy in the radiation pattern effectively drops off) approaching this geometric centre/null location. And the effect of this is that the amount of energy that the antenna radiates in a vertical upward direction is limited, which is important in order to prevent e.g. blinding reflections from the undersides of vehicles (as has been discussed elsewhere).

Another point to be made is that, whilst the antenna's radiation pattern may be described as extending further in one direction than another (i.e. more across the road (or more in a direction perpendicular to the direction of vehicle travel on the road) than down/along the road), and whilst the various views in FIG. 16 and FIG. 17 may appear to show that the radiation pattern consequently has a generally elliptical shape, in fact (i.e. in reality) the radiation pattern does not actually have any definite edge or boundary. Therefore, it is not correct to say that something is either inside, or outside, the antenna's radiation pattern. The antenna's radiation pattern (at least in a theoretical sense) actually extends in all directions and into all regions of space around the antenna (theoretically to infinity—i.e. the radiation pattern theoretically does not ever stop or end). However, the strength (or the energy density) of the antenna's emitted radiation drops or becomes lower (quite quickly) as distance from the antenna increases, and also energy is not radiated out by the antenna with the same/equal strength or intensity in all directions. On the contrary, energy is radiated by the antenna much more strongly in some directions and much less strongly in other directions. Thus, the seemingly elliptical shape of the antenna's radiation pattern is related to (or it comes about partly as a consequence of) the directions extending outward into the regions of three-dimensional space around the antenna where the density of the energy radiated by the antenna is greatest (i.e. the long axis of the ellipse generally corresponds to the direction in which the antenna emits energy with the greatest intensity—but see below for further discussion on the edge/boundary of the elliptical shape).

Following on from the above, whilst in theory the antenna's radiation pattern may be considered to extend to infinity, nevertheless due to the nature of digital electronics, there is (or there may be said to be) an edge or boundary within the antenna's radiation pattern, which may (in this instance) be thought of as defining the outer edge or boundary of the radiation pattern's elliptical shape. This edge or boundary is not, however, a feature of the radiation pattern itself, for the reasons discussed above. Rather this edge or boundary becomes defined as consequence of the relationship between the energy radiated by the antenna (as an RFID reader antenna) and the operation of an RFID tag that exchanges information with the (RFID reader) antenna. More specifically, the said edge or boundary within the (RFID reader) antenna's radiation pattern takes its shape (i.e. the surface shape of the ellipse e.g. as depicted in the Figures in this case) and it is defined by the locus of points in three-dimensional space where the density of the energy radiated the (RFID reader) antenna becomes great enough to communicate with an RFID tag that is within the (RFID reader) antenna's radiation pattern. This may be conveniently explained with reference to so-called passive RFID tags, although it is to be clearly understood that the present invention is by no means limited to use with only passive RFID tags (i.e. the invention could also be used with so-called active RFID tags and indeed any other forms of RFID tags). A passive RFID tag is an RFID tag that does not contain its own battery or other power source. Instead, a passive RFID tag is itself (i.e. the tag's antenna and also all of the tag's operating electronics are) powered by the energy radiated by the RFID reader antenna. Now, due to the nature of digital electronics, there will always be a certain minimum amount of power that is required in order to operate a given passive RFID tag (e.g. to enable it to power on and transmit a signal using its own antenna back to the RFID reader antenna, etc). Naturally, however, the amount of power that is required to operate different passive RFID tags may differ (note that the amount of power that a passive RFID tag requires to power on and operate is often described as the tag's sensitive). Accordingly, some passive RFID tags with lower sensitivity may need more power before they can power up and operate etc, and so these may need to get closer to the RFID reader antenna (where the density of the energy radiated by the antenna is greater) in order to operate and communicate with the RFID reader antenna. On the other hand, other passive RFID tags with higher sensitivity may require less power to turn on and operate, and therefore they may be able to turn on and operate at a greater distance from the RFID reader antenna. The point is that, as a result of this, the above-mentioned edge or boundary within the radiation pattern (i.e. the surface shape of the ellipse of the radiation pattern in this case, in three-dimensional space), which is defined by the locus of points where the density of the energy radiated by the antenna becomes great enough to enable an RFID tag to communicate with the RFID reader antenna, is not actually fixed. Rather, its location (i.e. how far out from the antenna this edge or boundary is) is dependent, assuming the amount of energy radiated by the antenna remains fixed/set, on the sensitivity of the RFID tag. Therefore, in the context of the present invention, the "size" of the ellipse of the antenna's radiation pattern (i.e. how "big" the ellipse is relative to the size of the antenna), assuming a set power output from the RFID reader antenna, will be larger for more sensitive tags and smaller for less sensitive tags.

However, a further point that must then be made is that, when the present invention is put into practice, the RFID tags used on vehicle license plates (regardless of whether they are passive RFID tags or some other form of tag) should have a sensitivity such that the "required read zone" (inside which the RFID reader must be able to communicate with a vehicle's plate-mounted RFID tag if the vehicle's tag is within the said region), the size and shape of which is described above with reference to FIG. 1 and FIG. 5 etc, falls within the ellipse of the antenna's radiation pattern. In other words, the power output from the RFID reader antenna should be such that, and in combination the sensitivity of the RFID tags on vehicle license plates should also be such that, there is no part of the required read zone described above that is outside the edge or boundary of the ellipse of the antenna's radiation pattern.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. An antenna for a communication device, the antenna having a structure including a ground plane and a lid component, wherein: the lid component is conductive, substantially planar and has a planform shape which is lesser in a first lid component dimension (L1) than in a second lid component dimension (L2) perpendicular to the first lid component dimension (L1), the ground plane is conductive, substantially planar and has a planform shape which has a first ground plane dimension (G1) and a second ground plane dimension (G2), where the first and second ground plane dimensions (G1 and G2) are parallel to the first and second lid component dimensions (L1 and L2) respectively, the size of the ground plane in the first ground plane dimension (G1) is greater than the size of the lid component in the first lid component dimension (L1) and the size of the ground plane in the second ground plane dimension (G2) is greater than the size of lid component in the second lid component dimension (L2), and the lid component is conductively connected to the ground plane but also spaced apart from the ground plane such that there is a space between the lid component and the ground plane, and the antenna is center fed, wherein energy/radiation radiated/emitted by the antenna emanates from between the ground plane and edge(s) of the lid component that extend in the direction of the second lid component dimension (L2) and wherein no energy/radiation is radiated/emitted from between the ground plane and edge(s) of lid component that extend in the direction of the first lid component dimension (L1).

2. An antenna for a communication device, the antenna having a structure including a ground plane and a lid component, wherein: the lid component is conductive, substantially planar and has a planform shape which is lesser in a first lid component dimension (L1) than in a second lid component dimension (L2) perpendicular to the first lid component dimension (L1), the ground plane is conductive and substantially planar, the size of the ground plane is greater than the size of the lid component; the lid component is conductively connected to the ground plane but also spaced apart from the ground plane, such that there is a space between the lid component and the ground plane, and the antenna is center fed, wherein energy/radiation radiated/emitted by the antenna emanates from between the ground plane and edge(s) of the lid component that extend in the direction of the second lid component dimension (L2) and wherein no energy/radiation is radiated/emitted from between the ground plane and edge(s) of lid component that extend in the direction of the first lid component dimension (L1).

3. The antenna as claimed in claim 1, wherein the lid component is spaced apart from but also parallel to the ground plane.

4. The antenna according to claim 1, wherein energy/radiation radiated/emitted by the antenna emanates from between the lid component and the ground plane.

5. The antenna according to claim 1, wherein the communication device is an RFID reader operable to be used in an application involving road vehicle detection and/or identification, and wherein, of the parts and components of the RFID reader, at least the antenna's ground plane is operable to be installed on the surface of the road.

6. The antenna according to claim 1, wherein the lid component is substantially rectangular with dimensions L1×L2, energy/radiation radiated/emitted by the antenna emanates from between the ground plane and the long edges of the substantially rectangular lid component that extend in the direction of the second lid component dimension (L2), and no energy/radiation is radiated/emitted from between the ground plane and the short edges of the substantially rectangular lid component that extend in the direction of the first lid component dimension (L1).

7. The antenna according to claim 1, wherein the planform shape of the lid component is lesser in the first lid component dimension (L1) than in the second lid component dimension (L2) by a factor f, where $0.3 \leq f \leq 0.75$.

8. The antenna according to claim 1, wherein the second lid component dimension (L2) is approximately half the antenna's operating signal wavelength (A) plus or minus a matching factor (x) of up to 20%, the antenna's operating signal is about 800 MHz to 1 GHz in frequency and in the direction of the second lid component dimension (L2) the lid component extends for between approximately 90 mm and approximately 260 mm.

9. The antenna according to claim 1, wherein the lid component is supported at a location spaced apart from the ground plane by one or more conductive support members, the distance that the lid component is spaced apart from the ground plane is defined by the length of the support members, the distance with which the support member(s) support the lid component apart from the ground plane is approximately the antenna's operating signal wavelength (λ) divided by a factor h, where $10 \leq h \leq 35$.

10. The antenna according to claim 1, wherein the ground plane includes a base plate, and the lid component is spaced apart from but also parallel to the base plate, such that the space between the lid component and the ground plane is the space between the lid component and the base plate, both of the lid component and the base plate are formed from a substantially rigid and conductive material, wherein the base plate is substantially planar and with a plan form shape that is larger than that of the lid component but smaller than that of the ground plane.

11. The antenna according to claim 1, wherein a filler or supporting material is provided in the space between the ground plane and the lid component.

12. The antenna according to claim 1 further including a protective cover.

13. The antenna as claimed in claim 12, wherein the protective cover is in contact with the ground plane and extends over the lid component in order to protect the lid component.

14. The antenna as claimed in claim 13, wherein the protective cover is in contact with the ground plane all the way around the lid component, and the lid component and the space between the ground plane and the lid component are enclosed within the ground plane and the protective cover.

15. The antenna according to claim 12, wherein the protective cover functions as a radome.

16. The antenna according to claim 12, wherein the protective cover is operable to assist the ground plane to lower a radiation pattern of the antenna.

17. The antenna according to claim 12, wherein the protective cover has one or more edges, which extend from the ground plane to the level of the lid component, and the one or more edges thereof have at least a portion which is sloping to assist in reducing impact or shock to a vehicle tire or the like that contacts or rolls over the protective cover or a portion of the protective cover.

18. The antenna as claimed in claim 17, wherein the one or more edges of the protective cover are straight along their length.

19. An RFID reader incorporating or operable to be used with an antenna as claimed in claim 1.

20. The antenna according to claim 1, wherein the lid component is spaced apart from the ground plane thereby forming a cavity between the lid component and the ground plane.

21. The antenna according to claim 2, wherein the lid component is spaced apart from the ground plane thereby forming a cavity between the lid component and the ground plane.

* * * * *